US010711585B2

(12) United States Patent
Zeng et al.

(10) Patent No.: US 10,711,585 B2
(45) Date of Patent: Jul. 14, 2020

(54) COMPLETIONS FOR TRIGGERING FRACTURE NETWORKS IN SHALE WELLS

(71) Applicants: UTI Limited Partnership, Calgary (CA); Southwest Petroleum University, Chengdu (CN)

(72) Inventors: Fanhui Zeng, Chengdu (CN); Jianchun Guo, Chengdu (CN); Zhangxing Chen, Calgary (CA); Xinfeng Jia, Calgary (CA); Xiaozhao Cheng, Chengdu (CN); Jamie Mcinnis, Calgary (CA)

(73) Assignees: UTI Limited Partnership, Calgary (CA); Southwest Petroleum University, Chengdu (CN)

( * ) Notice: Subject to any disclaimer, the term of this patent is extended or adjusted under 35 U.S.C. 154(b) by 0 days.

(21) Appl. No.: 16/159,146

(22) Filed: Oct. 12, 2018

(65) Prior Publication Data

US 2019/0112909 A1 Apr. 18, 2019

Related U.S. Application Data

(60) Provisional application No. 62/572,393, filed on Oct. 13, 2017.

(51) Int. Cl.
*E21B 43/26* (2006.01)
*E21B 43/267* (2006.01)

(52) U.S. Cl.
CPC ..... *E21B 43/26* (2013.01); *E21B 43/267* (2013.01)

(58) Field of Classification Search
CPC ..... E21B 43/26; E21B 43/267
See application file for complete search history.

(56) References Cited

U.S. PATENT DOCUMENTS 8,733,444 B2 5/2014 East, Jr. et al.
8,967,262 B2 * 3/2015 Jo ..... E21B 43/26 166/308.1

(Continued)

OTHER PUBLICATIONS

Akulich, A. and A. Zvyagin (2008). "Interaction between hydraulic and natural fractures." Fluid dynamics 43(3): 428-435 (8 pages).

(Continued)

*Primary Examiner* — James G Sayre
(74) *Attorney, Agent, or Firm* — Osha Liang LLP

(57) ABSTRACT

Techniques in horizontal well completions that facilitate multistage fracturing may be performed in shale gas reservoirs. The techniques may involve the creation of large scale fracture networks, connecting the reservoir and the wellbore, facilitated by activating pre-existing natural fractures (NFs). In addition, geo-mechanical characteristics facilitate the optimization of maximum stimulated reservoir volumes (SRVs). In particular, completion optimization patterns are provided for horizontal wellbores, designated herein as altered alternate fracturing (AAF) completions. Completion optimization patterns may involve a multi-step combination of simultaneous and alternate fracturing patterns. Additionally, the dynamic evolution and progression of NF growth are modeled using a variety of alternative criteria. Further, specific analyses are provided of how the well completion pattern influences the fracture network. A combination of perforation parameters is provided, together with approaches for real-time control of fluid injection rates, so as to induce stresses in a manner conducive to forming complex fracture networks.

16 Claims, 10 Drawing Sheets

(56) References Cited

U.S. PATENT DOCUMENTS

| | | | | |
|---|---|---|---|---|
| 2016/0194944 | A1* | 7/2016 | Walters | C09K 8/80 166/280.1 |
| 2018/0003033 | A1* | 1/2018 | Dawson | E21B 47/06 |
| 2018/0094514 | A1* | 4/2018 | Leem | E21B 43/26 |

OTHER PUBLICATIONS

Anderson, G. D. (1981). "Effects of friction on hydraulic fracture growth near unbonded interfaces in rocks." Society of Petroleum Engineers Journal 21(01): 21-29 (9 pages).
Barton, C. A., M. D. Zoback and D. Moos (1995). "Fluid flow along potentially active faults in crystalline rock." Geology 23(8): 683-686 (5 pages).
Chen, Z., X. Liao, X. Zhao, X. Dou and L. Zhu (2015). "Performance of horizontal wells with fracture networks in shale gas formation." Journal of Petroleum Science and Engineering 133: 646-664 (19 pages).
Cheng, Y. (2012). "Mechanical interaction of multiple fractures—exploring impacts of the selection of the spacing/number of perforation clusters on horizontal shale-gas wells." SPE Journal 17(04): 992-1001 (10 pages).
Cho, Y., E. Ozkan and O. G. Apaydin (2012). "Pressure-dependent natural-fracture permeability in shale and its effect on shale-gas well production." SPE Reservoir Evaluation & Engineering 16(02): 216-228 (18 pages).
Chuprakov, D., O. Melchaeva and R. Prioul (2014). "Injection-sensitive mechanics of hydraulic fracture interaction with discontinuities." Rock Mechanics and Rock Engineering 47(5): 1625-1640 (16 pages).
Cipolla, C. L. (2009). "Modeling production and evaluating fracture performance in unconventional gas reservoirs." Journal of Petroleum Technology 61(09): 84-90 (7 pages).
Clarkson, C. R. (2013). "Production data analysis of unconventional gas wells: Review of theory and best practices." International Journal of Coal Geology 109: 101-146 (46 pages).
Dahi-Taleghani, A. and J. E. Olson (2011). "Numerical modeling of multistranded-hydraulic-fracture propagation: Accounting for the interaction between induced and natural fractures." SPE journal 16(03): 575-581 (7 pages).
Daneshy, A. A. (1974). Hydraulic fracture propagation in the presence of planes of weakness. SPE European Spring Meeting, Society of Petroleum Engineers (8 pages).
De Barros, L., G. Daniel, Y. Guglielmi, D. Rivet, H. Caron, X. Payre, G. Bergery, P. Henry, R. Castilla and P. Dick (2016). "Fault structure, stress, or pressure control of the seismicity in shale? Insights from a controlled experiment of fluid?induced fault reactivation." Journal of Geophysical Research: Solid Earth 121(6): 4506-4522 (17 pages).
Economides, M. J. and K. G. Nolte (2000). Reservoir stimulation, Wiley New York (815 pages).
East, L., M. Y. Soliman and J. R. Augustine (2011). "Methods for enhancing far-field complexity in fracturing operations." SPE Production & Operations 26(03): 291-303 (13 pages).
Gale, J. F., R. M. Reed and J. Holder (2007). "Natural fractures in the Barnett Shale and their importance for hydraulic fracture treatments." AAPG bulletin 91(4): 603-622 (20 pages).
Genshen-Li, Li-Liu and Zhongwei-Huang (2006). "Study of effect of hydraulic perforation on formation fracturing pressure." Journal of China University of Petroleum 30(5): 42-45 (4 pages).
Gu, H., X. Weng, J. B. Lund, M. G. Mack, U. Ganguly and R. Suarez-Rivera (2012). "Hydraulic fracture crossing natural fracture at nonorthogonal angles: a criterion and its validation." SPE Production & Operations 27(01): 20-26 (7 pages).
Guo, T., S. Zhang, Z. Qu, T. Zhou, Y. Xiao and J. Gao (2014). "Experimental study of hydraulic fracturing for shale by stimulated reservoir volume." Fuel 128: 373-380 (8 pages).
Holditch, S. A. (2006). "Tight gas sands." Journal of Petroleum Technology 58(06): 86-93 (8 pages).
Huang, J., Z. Caineng, L. Jianzhong, D. Dazhong, W. Sheiiao, W. Shiqian and K. Cheng (2012). "Shale gas generation and potential of the Lower Cambrian Qiongzhusi Formation in the Southern Sichuan Basin, China." Petroleum Exploration and Development 39(1): 75-81 (7 pages).
Jaeger, J. C., N. G. Cook and R. Zimmerman (2009). Fundamentals of rock mechanics, John Wiley & Sons (489 pages).
Ketter, A. A., J. L. Daniels, J. R. Heinze and G. Waters (2008). "A field study in optimizing completion strategies for fracture initiation in Barnett Shale horizontal wells." SPE Production & Operations 23(03): 373-378 (6 pages).
Khristianovic, S. and Y. Zheltov (1955). Formation of vertical fractures by means of highly viscous fluids. Proc. 4th world petroleum congress, Rome (8 pages).
Kresse, O., X. Weng, H. Gu and R. Wu (2013). "Numerical modeling of hydraulic fractures interaction in complex naturally fractured formations." Rock mechanics and rock engineering 46(3): 555-568 (14 pages).
Kundu, T. (2008). Fundamentals of fracture mechanics, CRC press (305 pages).
Lam, K. and M. Cleary (1984). "Slippage and re?initiation of (hydraulic) fractures at frictional interfaces." International Journal for Numerical and Analytical Methods in Geomechanics 8(6): 589-604 (16 pages).
Laubach, S. E. (2003). "Practical approaches to identifying sealed and open fractures." AAPG bulletin 87(4): 561-579 (19 pages).
Leung, C. T. and R. W. Zimmerman (2012). "Estimating the hydraulic conductivity of two-dimensional fracture networks using network geometric properties." Transport in porous media 93(3): 777-797 (21 pages).
Liu, C., H. Liu, Y. Zhang, D. Deng and H. Wu (2015). "Optimal spacing of staged fracturing in horizontal shale-gas well." Journal of Petroleum Science and Engineering 132: 86-93 (9 pages).
Manchanda, R. and M. M. Sharma (2014). "Impact of Completion Design on Fracture Complexity in Horizontal Shale Wells." SPE Drilling & Completion 29(01): 78-87 (10 pages).
Mayerhofer, M. J., E. Lolon, N. R. Warpinski, C. L. Cipolla, D. W. Walser and C. M. Rightmire (2010). "What is stimulated reservoir volume?" SPE Production & Operations 25(01): 89-98 (10 pages).
Norbeck, J. H. and R. N. Horne (2016). "Physical mechanisms related to microseismic-depletion-delineation field tests with application to reservoir surveillance." SPE Journal (10 pages).
Roussel, N. P. and M. M. Sharma (2011). "Optimizing fracture spacing and sequencing in horizontal-well fracturing." SPE Production & Operations 26(02): 173-184 (12 pages).
Shakib, J. T. (2013). "RETRACTED: Numerical modeling of hydraulic fracture propagation: Accounting for the effect of stresses on the interaction between hydraulic and parallel natural fractures" Egyptian Journal of Petroleum 22(4): 557-563 (7 pages).
Sneddon, I. and H. Elliot (1946). "The opening of a Griffith crack under internal pressure." Quart. Appl. Math 4(3): 262-267 (6 pages).
Wang, X., C. Liu, H. Wang, H. Liu and H. Wu (2016). "Comparison of consecutive and alternate hydraulic fracturing in horizontal wells using XFEM-based cohesive zone method." Journal of Petroleum Science and Engineering 143: 14-25 (12 pages).
Warpinski, N. and L. Teufel (1987). "Influence of geologic discontinuities on hydraulic fracture propagation (includes associated papers 17011 and 17074)." Journal of Petroleum Technology 39(02): 209-220 (12 pages).
Weng, X., O. Kresse, C.-E. Cohen, R. Wu and H. Gu (2011). "Modeling of hydraulic-fracture-network propagation in a naturally fractured formation." SPE Production & Operations 26(04): 368-380 (13 pages).
Westergaard, H. (1997). "Bearing pressures and cracks." SPIE Milestone Series MS 137: 18-22 (3 pages).
Wu, K. and J. E. Olson (2015). "Simultaneous multifracture treatments: fully coupled fluid flow and fracture mechanics for horizontal wells." SPE journal 20(02): 337-346 (10 pages).
Xie, J., C. Yang, N. Gupta, M. J. King and A. Datta-Gupta (2015). "Integration of shale-gas-production data and microseismic for fracture and reservoir properties with the fast marching method." SPE Journal 20(02): 347-359 (18 pages).

(56) References Cited

OTHER PUBLICATIONS

Xing, L., Y. Xi, Z. Jiehui and S. Honglin (2011). "Reservoir forming conditions and favorable exploration zones of shale gas in the Weixin Sag, Dianqianbei Depression." Petroleum Exploration and Development 38(6): 693-700 (8 pages).
Yew, C. H. and X. Weng (2014). Mechanics of hydraulic fracturing, Gulf Professional Publishing (245 pages).
Yushi, Z., Z. Shicheng, Z. Tong, Z. Xiang and G. Tiankui (2016). "Experimental investigation into hydraulic fracture network propagation in gas shales using CT scanning technology." Rock Mechanics and Rock Engineering 49(1): 33-45 (14 pages).
Zeng, F. and J. Guo (2016). "Optimized Design and Use of Induced Complex Fractures in Horizontal Wellbores of Tight Gas Reservoirs." Rock Mechanics and Rock Engineering 49(4): 1411-1423 (13 pages).
Zhang, J., A. Kamenov, A. D. Hill and D. Zhu (2014). "Laboratory Measurement of Hydraulic-Fracture Conductivities in the Barnett Shale." SPE Production & Operations 29(03): 216-227 (12 pages).
Zhou, J., M. Chen, Y. Jin and G.-q. Zhang (2008). "Analysis of fracture propagation behavior and fracture geometry using a tri-axial fracturing system in naturally fractured reservoirs." International Journal of Rock Mechanics and Mining Sciences 45(7): 1143-1152 (10 pages).

* cited by examiner

COMPLETIONS FOR TRIGGERING FRACTURE NETWORKS IN SHALE WELLS

FIELD

Innovations are disclosed in the field of subterranean hydrocarbon recovery techniques, including methods for inducing complex fracture networks in horizontal shale wells.

BACKGROUND

Typical hydrocarbon shale formations are significantly different from conventional reservoirs, inasmuch as they are characterized by very low permeabilities, for example, with the permeability values in the nano-Darcy range (Cipolla 2009). To extract hydrocarbons from these formations, horizontal wells are often stimulated by multi-stage fracturing (Liu, Liu et al. 2015, Yushi, Shicheng et al. 2016)). Conventional hydraulic fracturing in horizontal wells is undertaken by placing several transverse fractures within a single stage (Holditch 2006), in a process that involves an interaction between induced and natural fractures (Dahi-Taleghani and Olson 2011). It is generally understood that the success of a fractured shale horizontal well is a function of the nature of the conductive fracture network, as determined by a parameter known as a stimulated reservoir volume (SRV) (Mayerhofer, Lolon et al. 2010, De Barros, Daniel et al. 2016). The induced fracture network is made up of reopened natural fracture (NF) networks and induced hydraulic fractures (HFs) formed by the opening or slippage of fractures initiated by the release of stresses resulting from hydraulic fracturing treatments (Gale, Reed et al. 2007, Cho, Ozkan et al. 2013). In this context, NFs can be understood as potential weak points for the initiation of HFs that extend the fracture network (Laubach 2003, Clarkson 2013, Kresse, Weng et al. 2013).

It has been widely reported that the existence of NFs in reservoir rock may change the direction or nature of induced HF propagation (Daneshy 1974; Anderson 1981; Zhou, Chen et al. 2008; Guo, Zhang et al. 2014). Similarly, a wide variety of theoretical approaches have been applied in an effort to characterize the nature of NF and HF interactions (Lam and Cleary 1984; Akulich and Zvyagin 2008; Shakib 2013; and, Chuprakov, Melchaeva et al. 2014). Much of this analysis fails to take into account the induced stress caused by multiple fractures, although efforts have been made to do so (East, Soliman et al. 2011; Cheng 2012; Zeng and Guo 2016)

The nature of a selected completion pattern is understood to have an important effect on the formation of complex fracture networks (East, Soliman et al. 2011, Manchanda and Sharma 2014, Wu and Olson 2015, Wang, Liu et al. 2016, Zeng and Guo 2016). One approach to completions in shale formations involves simultaneous fracturing of multiple perforation clusters in a horizontal wellbore, generally undertaken with essentially the same perforation parameters at perforation clusters that are relatively closely spaced, so that all of the perforation clusters initiate and propagate HFs simultaneously. In this way, the induced stresses of HFs may encourage the creation of stress interference between the successive fractures, thereby promoting fracture complexity (East, Soliman et al. 2011, Wu and Olson 2015). A different approach is known as alternate fracturing, in which a third fracture is placed between the two previously propped fractures. Altemate fracturing is thought to promote the introduction of complex fracture networks (Roussel and Sharma 2011, Manchanda and Sharma 2014). A wide variety of alternative fracturing techniques have been disclosed, many of which employ specialized tools (East, Soliman et al. 2011; Zeng and Guo 2016).

In the context of the present disclosure, various terms are used in accordance with what is understood to be the ordinary meaning of those terms. For example, a "reservoir" is a subsurface formation containing one or more natural accumulations of moveable petroleum or hydrocarbons, which are generally confined by relatively impermeable rock. In this context, "petroleum" or "hydrocarbon" is used interchangeably to refer to naturally occurring mixtures consisting predominantly of hydrocarbons in the gaseous, liquid or solid phase. A "zone" in a reservoir is an arbitrarily defined volume of the reservoir, typically characterised by some distinctive properties. Zones may exist in a reservoir within or across strata or facies, and may extend into adjoining strata or facies. "Fluids", such as petroleum fluids, include both liquids and gases. Natural gas is the portion of petroleum that exists either in the gaseous phase or in solution in crude oil in natural underground reservoirs, and which is gaseous at atmospheric conditions of pressure and temperature. Natural gas may include amounts of non-hydrocarbons. A "chamber" within a reservoir or formation is a region that is in fluid/pressure communication with a particular well or wells.

In reservoir rock, natural and/or induced fractures may form an interconnected network of fractures referred to as a "fracture network." A fracture network is "complex" when it comprises a significant number of interconnected fractures extending in alternative directions, or along alternative planes. As used herein, the phrase "fracturing interval" refers to a portion of a subterranean formation into which a fracture or fracture network may be introduced. In the context of hydrocarbon reservoirs, particularly gas reservoirs, "shale" is a fine-grained sedimentary rock that forms from the compaction of silt and clay-size mineral particles that is commonly called "mud". This composition places shale in a category of sedimentary rocks known as "mudstones". Shale is distinguished from other mudstones because it is fissile and laminated. "Laminated" means that the rock is made up of many thin layers. "Fissile" means that the rock readily splits into thin pieces along the laminations.

SUMMARY

Horizontal well drilling followed by multistage fracturing is used to unlock shale gas resources by creating large scale of fracture networks between the reservoir and wellbore. This is achieved by reactivating pre-existing natural fractures (NFs) through the optimization of well competitions. Approaches are provided that account for shale formation geomechanical characteristics, to achieve an optimized stimulated reservoir volume (SRV). The completion optimization pattern for a single horizontal wellbore is referred to herein as altered alternate fracturing (AAF). This completion pattern is a combination of conventional simultaneous and alternate fracturing. Previous approaches have focused on predicting the quasi-static dilation of NF failure. In contrast, the present disclosure assesses the dynamic evolution progression of NF growth under different failure criteria. An analysis of how this well completion pattern influences fracture networks is presented. Results demonstrate that a NF may be crossed, opened or slipped by an approaching HF as long as proper tensile or shear stresses are exerted on the HF. A combination of properly designed perforation parameters and real-time control of injection rates is shown to induce stresses so as to form complex fracture networks. Field applications reveal that production from an AAF completion pattern performs better than conventional simultaneous fracturing, as a result of increasing the nearby and far-field wellbore fracture complexity. Operationally, this approach may be implemented without the need for specialized equipment.

Accordingly, methods are provided for inducing a complex fracture network within a zone of a shale hydrocarbon reservoir, wherein the zone comprises a wellbore (such as a horizontal wellbore) servicing a plurality of spaced apart fracturing intervals. The reservoir rock may for example have very low permeability, for example of from 10-100 nD. The method may involve:

introducing in a fracturing stage contemporaneous fractures into a first fracturing interval and a third fracturing interval, and subsequently introducing during the fracturing stage a fracture into a second fracturing interval, wherein the second fracturing interval is between the first fracturing interval and the third fracturing interval;

wherein fracturing at the first, second and third fracturing intervals is initiated and extended by injection of a fracturing fluid into the intervals through the respective first, second and third perforation clusters in fluid communication through the wellbore and spaced apart along a wellbore casing;

controlling a fracture initiation stage and a hydraulic fracture propagation stage for each of the first, second and third perforation clusters by adjusting an injection rate of the fracturing fluid so as to modulate wellbore bottom pressure;

wherein during the fracture initiation stage:

$$p_b \leq p_{fr}$$

where $p_b$ is the bottom hole treating pressure, and $p_{fr}$ is the perforation cluster initiation pressure; and wherein during the hydraulic fracture propagation stage $p_b$ is adjusted so as to cross, open and shear natural fractures, with:

$$p_b = \sigma_h + p_{net} + p_{fef}$$

$$p_{net} = 2.52\left[\frac{E^2\mu_f q L_f}{(1-\nu^2)^3 H_f^4}\right]^{1/4}$$

$$L_f = 0.395\left[\frac{Eq^3}{2(1-\nu^2)\mu_f H_{HF}^4}\right]^{1/5} t^{4/5}$$

$$p_{fef} = \frac{22.45q^2\rho}{N_p^2 d^4 C_d^2}$$

where $\sigma_h$ is the horizontal minimum principal stress, MPa; $p_{net}$ is the HF net pressure, MPa; $p_{fef}$ is a pressure drop across perforations, MPa; E is Young's modulus of reservoir rock, MPa; $\mu_f$ is the injection fluid viscosity, mPa·s; q is the injection rate, $m^3$/min; $L_f$ is the fracture half-length, m; ν is the rock Poison's ratio, dimensionless; Pr is the injection fluid viscosity, mPa·s; $H_{HF}$ is the hydraulic fracture height, m; t is the injection time, s; ρ is the fracturing fluid density, $10^{-3}$ kg/$m^3$; Np is the perforation number; d is the perforation diameter, $10^{-2}$ m; $C_d$ is a flow rate coefficient, dimensionless;

wherein, for fracture initiation at perforation clusters 1 and 3, the bottom hole treating pressure is controlled by modulating the injection rate of the fracturing fluid so that:

$$p_{fr2} > p_b > p_{fr1} = p_{fr3}$$

$$p_b = p_{b1} = p_{b2} = p_{b3}$$

wherein subscript 1, 2, 3 represent parameters respectively for perforation clusters 1, 2 and 3;

wherein following the hydraulic fracture propagation stage at perforation clusters 1 and 3, the bottom hole treating pressure is increased to initiate the fracture initiation stage at perforation cluster 2, with the fracture initiation pressure for perforation cluster 2, $P_{fr2}$, being adjusted to account for the induced stress from hydraulic fracture propagation in the first and third fracturing intervals, so that:

$$p_{fr2} \leq p_b$$

$$p_b = p_{b1} = p_{b2} = p_{b3}$$

and wherein perforations in the perforation clusters are arranged and configured so that:

$$p_{fr2} > p_{fr1} = p_{fr3}.$$

In select embodiments, the fracture interval spacing and extension length may be selected so as to decrease principal stress anisotropy and thereby promote fracture network complexity through HF and NF interaction, wherein:

$$\Delta\sigma_x = K\cos\frac{\theta}{2}\left(1 - \sin\frac{\theta}{2}\sin\frac{3\theta}{2}\right)$$

$$\Delta\sigma_y = K\left(1 + \sin\frac{\theta}{2}\sin\frac{3\theta}{2}\right)$$

where $\Delta\sigma_x$, $\Delta\sigma_y$ are induced from a HF tip in the x, y direction, MPa.; $K = K_I/\sqrt{2\pi r}\cos(\theta/2)$, $K_I$ is the intensity factor of stress, MPa·$m^{1/2}$; $K_I = p_{net}\sqrt{\pi L_f}$, $p_{net}$ is the HF net pressure, MPa; $L_f$ is the HF half-length, m; r is the distance of an arbitrary point on a NF to the HF tip, m; θ is the angle of a certain point on the NF line to the HF tip with the maximum principal stress direction, °, and at the conjunction point, θ=β.

The length of each perforation in a perforation cluster may advantageously be adjusted so that it is at least about four times smaller than the wellbore diameter, thereby facilitating only one primary hydraulic fracture initiated from each perforation cluster. It will be understood that there may be more than 3 perforation clusters in one fracturing stage, with the foregoing principles applied to the additional perforation clusters mutatis mutandis.

DETAILED DESCRIPTION

In the following detailed description, various examples are set out of particular embodiments, together with procedures that may be used to implement a wide variety of modifications and variations of the exemplified embodiments. In general terms, these approaches reflect insights gained from a comprehensive analysis of how multi-stage HF parameters influence the evolution (reopening, slippage and crossing) of NFs. As a consequence of these insights, an altered alternative hydraulic fracturing method is disclosed, which implements combined aspects of simultaneous and alternate fracturing by making use of selected perforation patterns and real-time injection rate control. In addition, these approaches account for the total induced HF stresses that are exerted on NFs, to predict and optimize the evolution of NFs. A field application is described, exemplifying the merits of this approach.

Modeling HF Interactions with NFs

Figure 1:
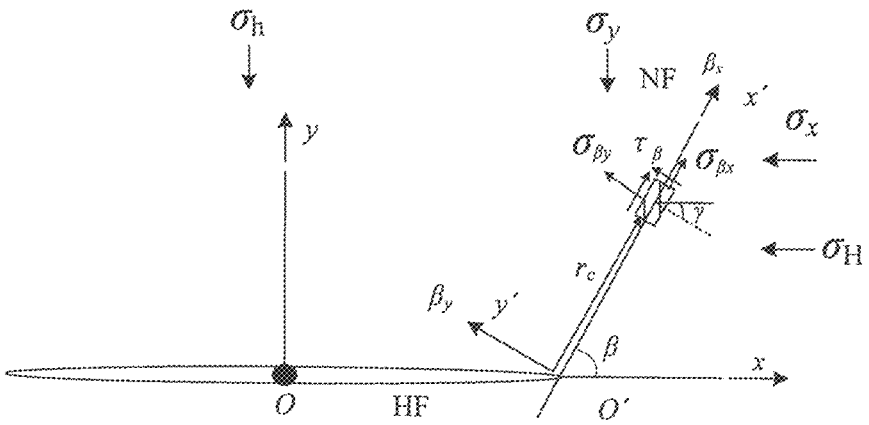
FIG. 1 is a schematic of a HF interacting with a NF.

In this model, a 2 dimensional pressurized HF is considered, with an inner pressure p that is a straight path along the x-axis approaching a preexisting NF. The NF is aligned with a reference plane of Oxy, which is compressed by in-situ principal stresses of $\sigma_H$ and $\sigma_h$. The two fractures are in contact at the conjunction point O' with intersecting angle β (FIG. 1).

As the HF approaches, the NF fluid pressure will increase gradually as a result of the fluid transferred from the HF. The NF will accordingly be activated in reopening, slipping or reinitiating in the area surrounding the fracture conjunction point due to the induced stress (Sneddon and Elliot 1946, Yew and Weng 2014). We define a local coordinate system O'x'y' with respect to a NF, where the axis of O'x' coincides with the NF, and the O'y' axis is perpendicular to NF. The slippage zone at the NF, reinitiation at the NF is $r_c$, and the new reinitiation fracture angle is γ, respectively (FIG. 1).

Governing Equations of HF Contact with NF

The total stress field load on the HF is a combination of the in-situ stresses and the HF tip induced stresses (Roussel and Sharma 2011). For shale gas rock of ultra-low permeability, the fluid leakage is minimal and poroelastic effects may be neglected during fracturing (Zeng and Guo 2016). The normal and shear stresses induced from a uniformly pressurized fracture of length of 2a are discussed by Yew (Yew and Weng 2014).

In Situ Stresses in Coordinate x and y Directions

The total stresses exerted on the NF interface caused by $\sigma_H$, $\sigma_h$ and the HF tip induced stress are:

$$\sigma_x = \sigma_H + K\cos\frac{\theta}{2}\left(1 - \sin\theta_2\sin\frac{3\theta}{2}\right) \tag{1}$$

$$\sigma_y = \sigma_h + K\left(1 + \sin\frac{\theta}{2}\sin\frac{3\theta}{2}\right) \tag{2}$$

$$\tau_{xy} = K\sin\frac{\theta}{2}\cos\frac{\theta}{2}\cos\frac{3\theta}{2} \tag{3}$$

where $\sigma_x$ and $\sigma_y$ are normal stresses exerted on the interface direction of x, y respectively, MPa; $\tau_{xy}$ is the shear stress exerted on the interface in XY direction, MPa; $K=K_I/\sqrt{2\pi r}\cos(\theta/2)$, $K_I$ is the intensity factor of stress, $MPa\cdot m^{1/2}$; $K_I=p_{net}\sqrt{\pi L_f}$, $p_{net}$ is the HF net pressure, MPa; $L_f$ is the HF half-length, m; r is the distance of an arbitrary point on NF to the HF tip, m; θ is the angle of certain point at the NF line to the HF tip with the maximum principal stress direction, °, and at the conjunction point, θ=β.

In Situ Stresses in Coordinate βx and βy Directions

Transforming the in-situ stresses $\sigma_H$, $\sigma_h$ into local coordinate's βx, βy, we can obtain.

$$\sigma_{t,\beta x} = \frac{\sigma_H + \sigma_h}{2} + \frac{\sigma_H - \sigma_h}{2}\cos 2\beta \tag{4}$$

$$\sigma_{t,\beta y} = \frac{\sigma_H + \sigma_h}{2} - \frac{\sigma_H - \sigma_h}{2}\cos 2\beta \tag{5}$$

$$\tau_{t,\beta} = -\frac{\sigma_H - \sigma_h}{2}\sin 2\beta \tag{6}$$

The HF tip induced stresses are expressed as follows:

$$\sigma_{tip,\beta x} = K - K\sin\frac{\theta}{2}\sin\frac{3\theta}{2}\cos 2\beta + K\sin\frac{\theta}{2}\cos\frac{3\theta}{2}\sin 2\beta \tag{7}$$

$$\sigma_{tip,\beta y} = K + K\sin\frac{\theta}{2}\sin\frac{3\theta}{2}\cos 2\beta - K\sin\frac{\theta}{2}\cos\frac{3\theta}{2}\sin 2\beta \tag{8}$$

$$\tau_{tip,\beta} = K\sin\frac{\theta}{2}\sin\frac{3\theta}{2}\sin 2\beta + K\sin\frac{\theta}{2}\cos\frac{3\theta}{2}\cos 2\beta \tag{9}$$

where $\sigma_{r,\beta x}$, $\sigma_{r,\beta y}$, $\sigma_{tip,\beta x}$ and $\sigma_{tip,\beta y}$ are the normal stresses exerted on the NF interface in the $\beta_x$, $\beta_y$ direction caused by the in-situ and HF tip induced stresses, MPa; $\tau_{r,\beta}$ and $\tau_{tip,\beta}$ represent the shear stresses resulted from the in-situ and HF tip induced stresses, MPa.

Considering the HF intersection with the NF, the total principal stresses can be superimposed from the HF tip induced stresses and the remote stresses:

$$\sigma_{\beta x} = \sigma_{tip,\beta x} + \sigma_{r,\beta x} \tag{10}$$
$$= K - K\sin\frac{\theta}{2}\sin\frac{3\theta}{2}\cos 2\beta + K\sin\frac{\theta}{2}\cos\frac{3\theta}{2}\sin 2\beta +$$
$$= \frac{\sigma_H + \sigma_h}{2} + \frac{\sigma_H - \sigma_h}{2}\cos 2\beta$$

$$\sigma_{\beta y} = \sigma_{tip,\beta y} + \sigma_{r,\beta y} \tag{11}$$
$$= K - K\sin\frac{\theta}{2}\sin\frac{3\theta}{2}\cos 2\beta + K\sin\frac{\theta}{2}\cos\frac{3\theta}{2}\sin 2\beta +$$
$$= \frac{\sigma_H + \sigma_h}{2} - \frac{\sigma_H - \sigma_h}{2}\cos 2\beta$$

Similarly, the total shear stress can be superimposed from Eq. (6) and Eq. (9):

$$\tau_\beta = \tau_{tip,\beta} + \tau_{r,\beta} = \tag{12}$$
$$K\sin\frac{\theta}{2}\sin\frac{3\theta}{2}\sin 2\beta + K\sin\frac{\theta}{2}\cos\frac{3\theta}{2}\cos 2\beta - \frac{\sigma_H - \sigma_h}{2}\sin 2\beta$$

NF Evolution as HF Approaches

As the HF approaches the NF, the NF may be broken by opening, tearing and crossing (Weng, Kresse et al. 2011). Among the three fracture failure modes, the opening and crossing correspond to tensile failure, while tearing is associated with shear failures.

Reopening of NFs

The required fluid pressure in the HF should be at least equal to $\sigma_{\beta y}$ acting normal to the fracture plane to open a closed NF:

$$p \geq \sigma_{\beta y} \tag{13}$$

Generally speaking, a linearly extending fracture requires the least pressure to promote HF growth, which can be expressed as follows (Chuprakov, Melchaeva et al. 2014):

$$p = \sigma_h + p_{net} \tag{14}$$

where p is the fluid pressure in HF, MPa.

The open width of a NF can be estimated under the elasticity theory for the plane-strain (Khristianovic and Zheltov 1955):

$$w = \frac{2(1-\nu)(p - \sigma_{\beta y})H_{NF}}{E} \tag{15}$$

where ν is the rock's Poisson's ratio, dimensionless; H is the height of the NF, m; E is the rock's Young's modulus, MPa.

Shear Slippage of NF

Shear slippage will occur once the normal stress exerted on the plane of a NF is smaller than the required force to prevent weak planes sliding, and the formula can be given as (Economides and Nolte 2000):

$$|\tau_\beta| > \tau_o - \mu(\sigma_{\beta y} - p_o) \tag{16}$$

where $\tau_o$ is the NF plane inherent shear strength, MPa; μ is the coefficient of friction, dimensionless; $p_o$ is the pay zone pore pressure, MPa.

The NF shear displacement can be expressed as (Westergaard 1997, Kundu 2008):

$$u_s = \left(\frac{k+1}{4G}\right)\cdot \tau_\beta \cdot l\sqrt{1-(x/l)^2} \tag{17}$$

where $u_s$ is the NF shear displacement, m; k is the Kolosov constant, k=3-4ν, dimensionless; G is the shear modulus, G=E/2(1+ν), MPa; l is the NF length, m; x is an arbitrarily point on the NF, m.

Crossing of NF

To reinitiate a new fracture on the NF surface, the required effective maximum principal stress must be larger than the rock tensile strength:

$$\sigma_1 > T_0 \tag{18}$$

where $T_0$ is the tensile strength of rock, MPa.

The effective maximum principal stress can be expressed as (Warpinski and Teufel 1987):

$$\sigma_1 = \frac{\sigma_{\beta x} + \sigma_{\beta y}}{2} + \sqrt{\left(\frac{\sigma_{\beta x} - \sigma_{\beta y}}{2}\right)^2 + \tau_\beta^2} \tag{19}$$

and the new fracture reinitiating angle γ is:

$$\gamma = \frac{1}{2}Am\left(\frac{2\tau_\beta}{\sigma_{\beta x} - \sigma_{\beta y}}\right) \tag{20}$$

where γ is the angle of the new reinitiated fracture, °.

When a fracture reinitiates at an arbitrary point at the surface according to Eq. (18), slip should not occur (Jaeger, Cook et al. 2009).

In order to solve for the critical circle radius $r_c$, we set $$T = T_o - \frac{\sigma_H + \sigma_h}{2},$$

and then substitute equations (1), (2), (3), and (19) into (18). The following expression can be obtained:

$$\cos^2\frac{\theta}{2}K^2 + 2\left[\left(\frac{\sigma_H - \sigma_h}{2}\right)\sin\frac{\theta}{2}\sin\frac{3\theta}{2} - T\right]K + \left[T^2 - \left(\frac{\sigma_H - \sigma_h}{2}\right)^2\right] = 0 \tag{21}$$

assuming $m = \cos^2\frac{\theta}{2}$, $n = 2\left[\left(\frac{\sigma_H - \sigma_h}{2}\right)\sin\frac{\theta}{2}\sin\frac{3\theta}{2} - T\right]$ and $j = \left[T^2 - \left(\frac{\sigma_H - \sigma_h}{2}\right)^2\right]$.

Eq. (21) can be simplified to:

$$mK^2 + nK + j = 0 \tag{22}$$

There are two solutions to equation (22) whose maximum principal stress equals to the tensile strength of rock corresponding to the critical distance $r_c$:

$$r_c = \left[\frac{K_1}{\sqrt{2\pi K}}\cos\frac{\theta}{2}\right]^2 \tag{23}$$

Shale Gas Horizontal Well Optimized Completion Design

An important determining factor for whether shale gas formation fracturing creates complex fractures, or not, is the behavior of a HF when it intersects a NF (opening, shearing or crossing to reinitiate a new fracture). In this context, an important factor is the nature of the well completion, particularly: the number of perforation clusters, initiation sequence, the length of former initiation extension distance and construction parameters. As exemplified herein, these parameters may be selected so as to generate sufficient induced stresses to change fracture complexity. In essence, the purpose of horizontal shale well hydraulic fracturing optimization is to activate existing weakness planes and NFs by hydraulic fracturing. The mechanisms at work in generating complex fracture networks accordingly include the following four aspects of hydraulic fracturing:

1) Opening of NFs. If a HF opens a NF and propagates the NF for a distance, this will promote a complex fracture network.

2) Slippage of NFs. If critically stressed fractures are exposed to sufficient shear stress to overcome resistance to sliding, these fractures are more likely to be hydraulically conductive in a manner that accommodates gas seepage (Barton, Zoback et al. 1995).

3) Crossing of NFs. If the HF dilates and propagates along the NF for a sufficient distance, and then crosses a NF, a complex fracture network may result in (Gu, Weng et al. 2012).

4) Alteration of HF propagation direction. A HF will generally propagate along in the minimum horizontal stress direction. If the local stress state is altered, or even reversed as a result of stress interference, a change may occur in the HF propagation pattern aiding in the formation of a complex fracture network (Zeng and Guo 2016):

$$\sigma_H-\sigma_h\leq\Delta\sigma_y-\Delta\sigma_x \tag{24}$$

where $\Delta\sigma_y$, $\Delta\sigma_x$ are induced from the HF tip in the y, x direction, MPa., $$\Delta\sigma_x = K\cos\frac{\theta}{2}\left(1-\sin\frac{\theta}{2}\sin\frac{3\theta}{2}\right) \tag{25}$$

$$\Delta\sigma_y = K\left(1+\sin\frac{\theta}{2}\sin\frac{3\theta}{2}\right) \tag{26}$$

for the induced stresses resulting from multistage horizontal well fracturing, which can be obtained by the superposition principle (Zeng and Guo 2016).

Optimized Well Completion Design Model

Many factors affect an interaction of HFs with NFs during the formation of complex fracture networks. The relevant parameters can be divided into natural properties of the formation (in-situ stress, an approaching angle, a NF friction coefficient, and tensile strength) and operator controllable parameters, such as injection rates and perforation cluster distance. In order to significantly increase fracture complexity, the induced stresses, construction parameters and well completion strategy must be considered in combination (Ketter, Daniels et al. 2008, East, Soliman et al. 2011, Roussel and Sharma 2011, Zeng and Guo 2016). A novel methodology is accordingly disclosed that utilizes perforation cluster optimization in combination with injection rate control in real time, within the specific context of the natural properties of the formation, to provide complex fracture networks.

Figure 2:
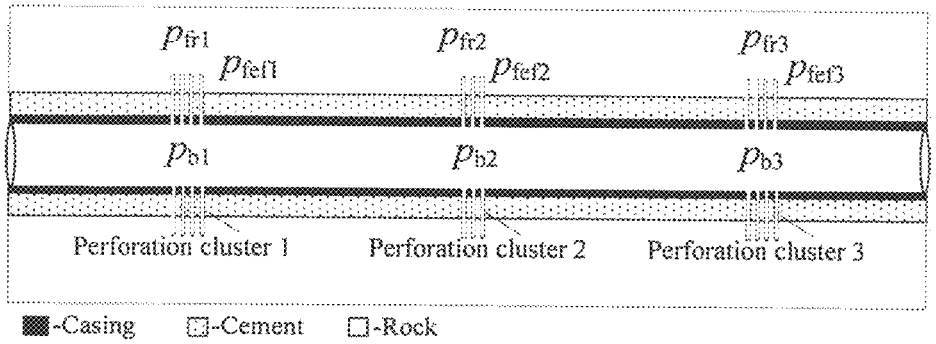
FIG. 2 is a schematic of a fracture network resulted from optimized completion design.

In an exemplified embodiment, three perforation clusters are provided within one fracturing stage, as discussed in detail below and illustrated in FIG. 2.

An aspect of the disclosed approach involves controlling the initiation and extension sequence for different perforation clusters by modulation of wellbore bottom treating pressure through adjustment of fluid injection rates. The bottom hole treating pressure is determined by different formulas in the perforation initiation and extension stages. Before and during the stage of perforation cluster initiation:

$$p_b\leq p_{fr} \tag{27}$$

where $p_b$ is the bottom hole treating pressure, MPa; $p_{fr}$ is the perforation cluster initiation pressure, MPa.

During the hydraulic fracture propagation stage:

$$p_b = \sigma_h + p_{net} + p_{fef} \tag{28}$$

$$p_{net} = 2.52\left[\frac{E^3\mu_f q L_f}{(1-\nu^2)^3 H_f^4}\right]^{1/5} \tag{29}$$

$$L_f = 0.395\left[\frac{Eq^3}{2(1-\nu^2)\mu_f H_{HF}^4}\right]^{1/5} t^{4/5} \tag{30}$$

$$p_{fef} = \frac{22.45q^2\rho}{N_p^2 d^4 C_d^2} \tag{31}$$

where E is Young's modulus of rock, MPa; $\mu_f$ is the injection fluid viscosity, mPa·s; q is an injection rate, $m^3$/min; $L_f$ is the fracture half-length, m; ν is the rock Poison's ratio, dimensionless; $H_{HF}$ is the hydraulic fracture height, m; t is the injection time, s; $p_{fef}$ is a pressure drop across perforation, MPa; ρ is the fracturing fluid density, $10^{-3}$ kg/$m^3$; Np is the perforation number; d is the perforation diameter, $10^{-2}$ m; $C_d$ is a flow rate coefficient, dimensionless.

As disclosed herein, first, perforation clusters 1 and 3 initiate and propagate essentially simultaneously, and, subsequently, perforation cluster 2 initiates and propagates. This is achieved by implementing the following steps:

Step 1: During the fracture initiation stage, at the moment of cluster 1 and cluster 3 initiation, the bottom hole treating pressure is controlled so as to satisfy equation (27), whereby:

$$p_{fr2}>p_b>p_{fr1}=p_{fr3} \tag{32}$$

$$p_b=p_{b1}=p_{b2}=p_{b3} \tag{33}$$

where subscripts 1, 2, and 3 represent clusters 1, 2, and 3, respectively. Assuming very little frictional pressure drop along a relatively short wellbore length, it is reasonable to treat the well bottom treating pressure as the same for perforation cluster 1, cluster 2 and clusters 3.

Step 2: Once fractures initiate in cluster 1 and cluster 3, fracture fluid flow is through fracture 1 and fracture 3, which results in an additional pressure drop across the perforations. Accordingly, during the extension stage of fracture interval 1 and fracture interval 3, the bottom hole treating pressure is determined by the fracture fluid pressure and perforation friction pressure, and bottom-hole pressure is controlled as follows:

$$p_{fr2}>p_b \tag{34}$$

where $p_{HF1}$, $p_{HF2}$ are the fluid pressure in hydraulic fractures 1 and 2 separately, MPa.

Step 3: As fractures in fracture interval 1 and fracture interval 3 propagate towards a selected length, the bottom hole treating pressure may be increased so as to exceed the perforation initiation pressure at perforation cluster 2, by increasing injection rates, so that:

$$p_b>p_{fr2} \tag{35}$$

During the hydraulic fracturing process, the bottom hole treating pressure $p_b$ is generally connecting to the wellhead pressure:

$$p_w = p_b - p_h + p_t \quad (36)$$

where $p_w$ is the wellhead pressure, MPa; $p_h$ is the hydrostatic pressure, MPa; $p_t$ is the pressure dropped caused by fluid friction in tubing, MPa.

The bottom hole treating pressure is strongly reliant on injection rates (Eqs. (28)-(31)), and real-time control of the injection rates is accordingly an aspect of the disclosed approaches to controlling the initiation and extension order of alternative perforation clusters. As described in more detail below, numerical procedures are provided that facilitate this operational management to facilitate real-time control of induced stresses and thereby enhance complexity of fracture networks (in a fracture interval that includes regions both adjacent to the wellbore and distant therefrom). In summary, this approach involves the following aspects:

- The magnitude of in-situ stress, rock mechanical properties, and NF angles are obtained and used to calculate the required net pressure to open, slip and cross NFs according to Eqs. (13)-(23).
- A prediction model for fracture initiation pressure is applied to optimize perforation parameters to orchestrate a process in which perforation cluster 1 and perforation cluster 3 are initiated and grow before this takes place at perforation cluster 2, within a single-stage fracturing process.
- Induced stress determinations, as represented by formulae Eqs. (25) and (26), are used to select a favorable fracture interval spacing and fracture extension length, so as to decrease principal stress anisotropy, thereby promoting fracture network complexity through slippage and crossing at fracture intersections.
- The hydraulic fracture induced stresses (Eqs. (25) and (26)), net pressure and friction pressure drop formulae, Eqs. (28)-(31)) are used to adjust the bottom hole treating pressure, by way of flow rate modulation, in real time, to orchestrate the perforation cluster initiation and extension order.

EXAMPLES: FIELD APPLICATION

The foregoing principles and procedures are implemented in this Example in a well completion in a LMX shale gas field.

Reservoir Characteristics

Figure 3:
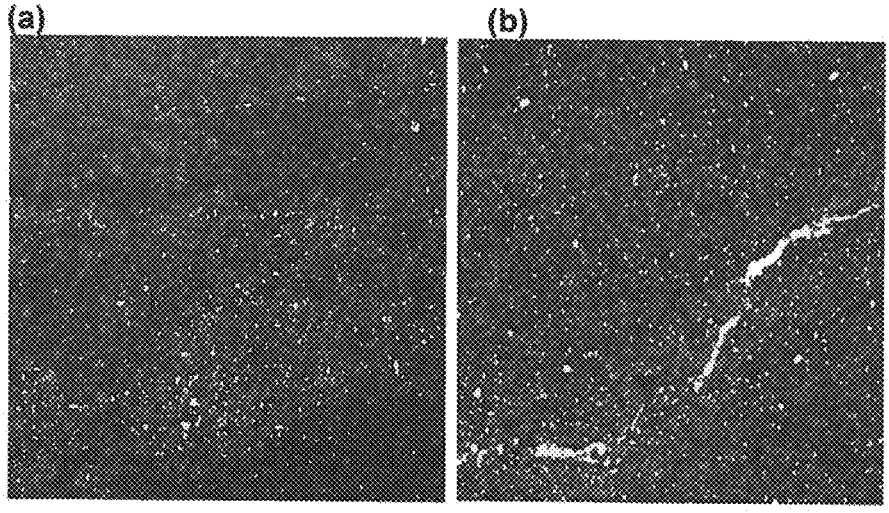
FIG. 3 NFs are found abundant in the QZS shale: (a) Class-one fractures: Core with full-filled NFs (2307 m); (b) Class-two fractures: Core with unfilled NFs (white material in image, 2310 m).
Figure 4:
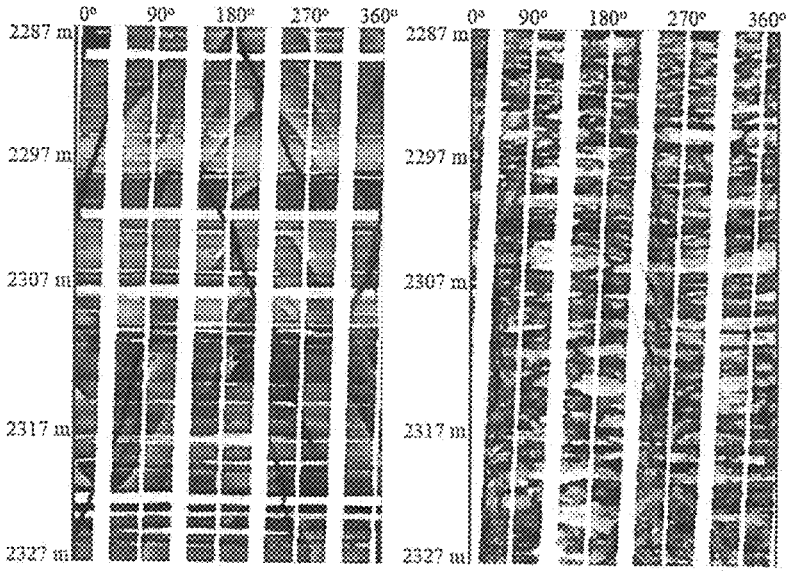
FIG. 4 Examples of NFs are observed in the image log in two vertical wells (2287-2327 m).

The LMX formation is deposited in the foreland basin of the Caledonian orogenic belt in Southwestern China. In this context, brittle mineral content is a critical factor affecting matrix porosity, micro-fractures and gas content (Xing, Xi et al. 2011). The lithology in the LMX formation is dominantly quartz with feldspar, and clay minerals are dominated by illites, with minor presence of chlorite and mica. Porosity of the QZS shale ranges from 0.82% to 4.86% (its average value is 2.44%), and permeability is $0.006\times10^{-3}$ $\mu m^2$ to $0.158\times10^{-3}$ $\mu m^2$ (its average value is $0.046\times10^{-3}$ $\mu m^2$) (Huang, Caineng et al. 2012). FIGS. 3 and 4 reveal the NF development in this area depicted by core images and image logs.

NFs are abundant in the QZS shale core samples, which can be separated into two different types. Class-one fractures are completely filled (FIG. 3*a*). Class-two fractures, which were documented using image log data, are interpreted as being un-filled (FIG. 3*b*). The existence of NFs represents a potential plane of weakness that may be broken, so that additional shear displacement on the fractures will create additional permeability between asperities (Leung and Zimmerman 2012, Zhang, Kamenov et al. 2014).

From an image log analysis, as illustrated in FIG. 4, it was determined that each wellbore contained two NF orientations. One is roughly parallel to the regional maximum horizontal principal stress N45° E with high open angles (>60°) and the other is roughly orthogonal to it. Also, the dominant fracture orientation varied from well to well over the field area. Table 1 lists a summary of parameters for exemplary calculation purposes in the LMX formation.

TABLE 1

A summary of parameters

| Parameters | Values | Parameters | Value |
|---|---|---|---|
| Pay zone thickness (m) | 40 | NF friction coefficient | 0.9 |
| Reservoir permeability ($10^{-3}$ $\mu m^2$) | 0.0006 | Rock tensile strength (MPa) | 3 |
| Horizontal maximum principal $\sigma_H$ (MPa) | 50 | Fracturing fluid viscosity (mPa · s) | 20 |
| Horizontal minimum principal $\sigma_h$ (MPa) | 45 | HF net pressure $p_1$ (MPa) | 5 |
| Horizontal maximum principal azimuth (°) | 90 | HF net pressure $p_2$ (MPa) | 5 |
| Horizontal well-bore azimuth (°) | 0 | HF half-length $L_{f1}$ (m) | 60 |
| Approaching angle (°) | 60 | HF half-length $L_{f2}$ (m) | 60 |
| NF azimuth (°) | 140 | HF height $h_{HF1}$ (m) | 20 |
| Poisson's ration (dimensionless) | 0.22 | HF height $h_{HF2}$ (m) | 20 |
| Young's modulus (MPa) | 20,000 | NF half-length $L_{NF}$ (m) | 5 |
| Rock cohesion (MPa) | 10 | NF height $h_{NF}$ (m) | 0.5 |

In QZS, a constructive interaction of HFs with NFs is especially beneficial for the success of hydraulic fracturing in this low permeability shale gas reservoir. This Example accordingly provides a systematic protocol that may be applied to design treatments for a variety of similar shale gas horizontal well completions. This Example illustrates how specific in-situ conditions determine the selection of particular operational parameters. The following sections accordingly first describe the stresses exerted on the NFs as HFs approach, and then analyze the controllable construction parameters required to open, shear and/or cross the NFs. This is followed by a description of operational procedures that are implemented to achieve the desired result of creating a complex fracture network.

Evolution of Stresses Exerted on NF Faces as HF Approaches

Figure 5:
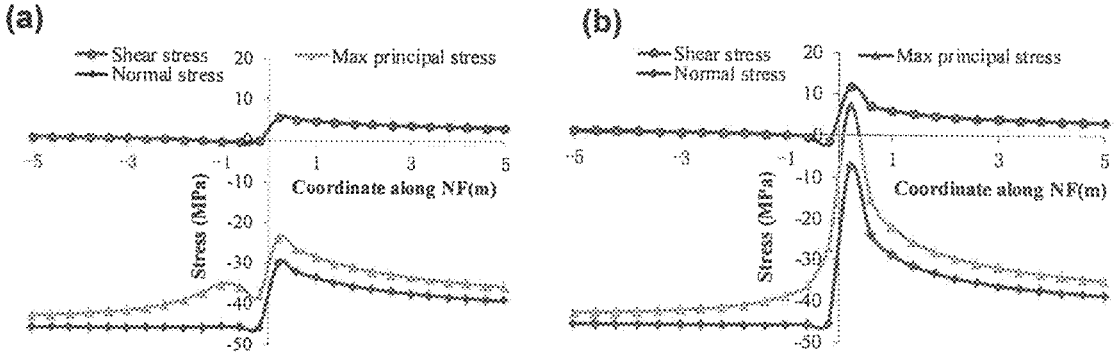
FIG. 5 Profiles of stresses are exerted on NF surfaces: (a) Distance between a HF tip and NF is 1.0 m; (b) HF tip and NF are completely coalescence.

The magnitude of the shear, normal and maximum principal stress peak grows as a HF tip approaches a NF, and achieves maximal values when the fractures coalesce. Before the HF contacts the NF (FIG. 5*a*), all of the NF is under a compressive stress state, and the positive shear stress achieves peaks behind the HF tip, at 0.2 m with the right lateral (FIG. 1). After coalescence (FIG. 5*b*), all the stresses increase gradually, the shear achieves a magnitude peak in front of the fracture tip, and also the maximum principal stress becomes tensile.

Evolution of NF as HF Coalesces with NF

From the above analysis, the magnitudes of the shear stress, normal stress and maximum principal stress peaks exist behind the HF tip. Accordingly, an analysis of this area illustrates how a NF evolves.

Figure 6:
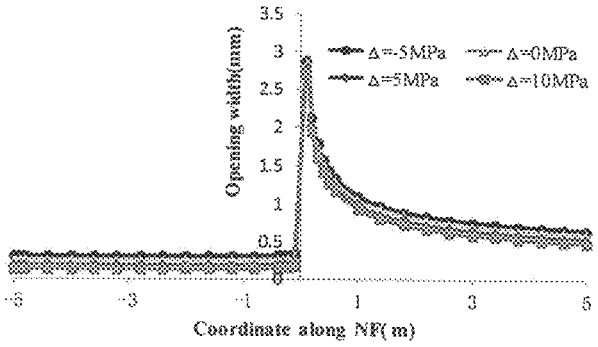
FIG. 6 NF opening width varies with a stress difference.
Figure 7:
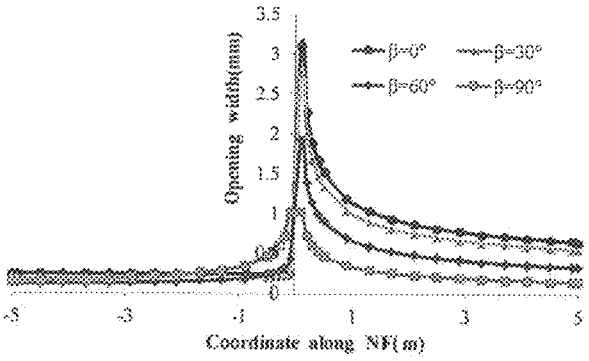
FIG. 7 NF opening width varies with an approaching angle.

FIG. 6 illustrates the opening width profiles along the NF under a stress difference: $\Delta=\sigma_H-\sigma_h$. The peaks of the largest openings are placed at the smallest distance ahead of the conjunction point. The NF opening width decreases as the stress difference increases, which is adverse for NF accepting proppants to keep NF opened and provide conductivity. Also, the opening width becomes small gradually as the distance increases away from the intersection point. FIG. 7 displays the opening width profiles produced along the NF for different approaching HF angles. When the approaching angle is 0°, the opening width of the NF at the positions ahead of the conjunction point is largest. The peaks of the largest opening width occur at the least distance from the right of the conjunction point.

Figure 8:
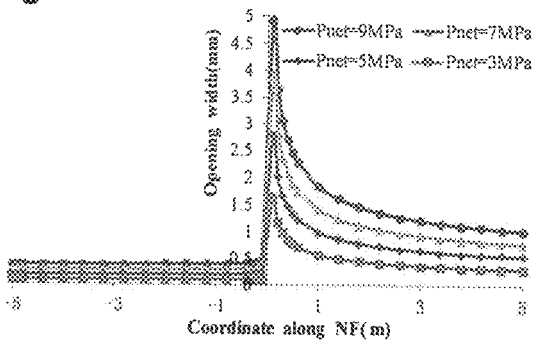
FIG. 8 Opening width varies with net pressure.
Figure 9:
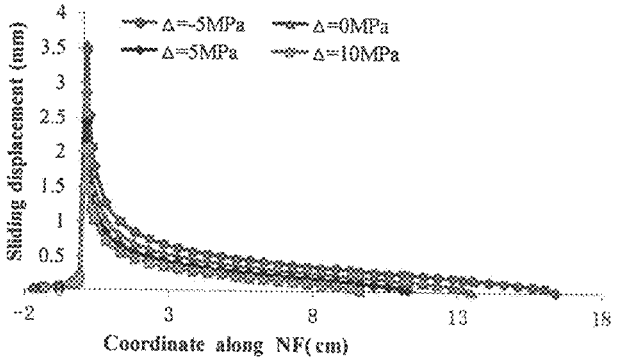
FIG. 9 Sliding displacement varies with a stress difference.

FIG. 8 displays the opening displacement profiles produced along the NF for a given net pressure. The opening width increases as the net pressure increases, which is beneficial for promoting NF transport of proppants. The triggered opening fractures in the shale reservoir rapidly shrink, so that it is essential to fill the NFs with proppants. The net pressure is closely related to construction displacement, which provides a gap to optimize the controllable construction parameters for the purpose of opening the NFs widely. As the normal stress decreases, slippage may occur under the prevailing shear stress (FIG. 9). The peaks of the largest opening exist to the right of the conjunction point. The slippage displacement of the NFs falls as the in-situ principal horizontal stress difference increases.

Figure 10:
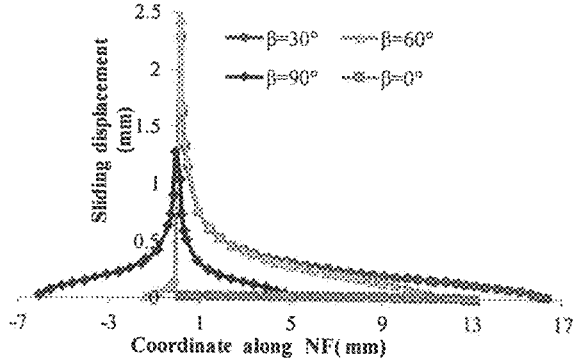
FIG. 10 Sliding displacement varies with an approaching angle.
Figure 11:
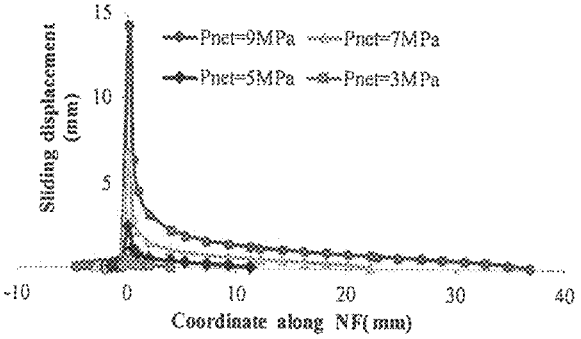
FIG. 11 Sliding displacement varies with net pressure.

From FIG. 10, it is clear that the sliding displacement and distance along the NF increases first, and then decreases as the approaching angle increases. When the approaching angle is 30°, the shear displacement of the conjunction point is 2.3 mm and the shear appearance along the NF is 16.8 mm. When the approaching angle is 90°, the sliding displacement decreases sharply to 1.25 mm. FIG. 11 displays the sliding displacement profiles produced along the NF for different net pressures. The slippage displacement increases as the net pressure increases. When the net pressure falls to 3 MPa, the slippage displacement is 0.

Figure 12:
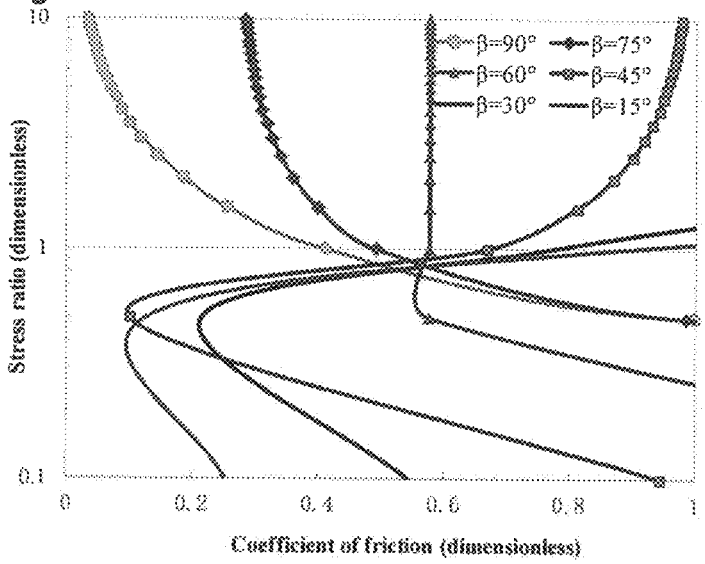
FIG. 12 A case of crossing criterion for a stress ratio.

FIG. 12 shows the cross relationship of HF interactions with NFs. The right region of each curve represents the crossing condition, while the left region represents the non-crossing condition. As the approaching angle decreases from 90° to 15°, it is more difficulty for the HF to cross the NF. The large gap between these curves illustrates that the approaching angle has a profound effect on the fracture crossing condition. The parameters of an approaching angle and a coefficient of friction are determined by in situ geological factors. However, as the stress anisotropy decreases, there is an increased opportunity for HFs to cross NFs, and this is amenable to controllable measures implemented so as to reduce the stress anisotropy and thereby promote HFs crossing NFs (Weng, Kresse et al. 2011).

Figure 13:
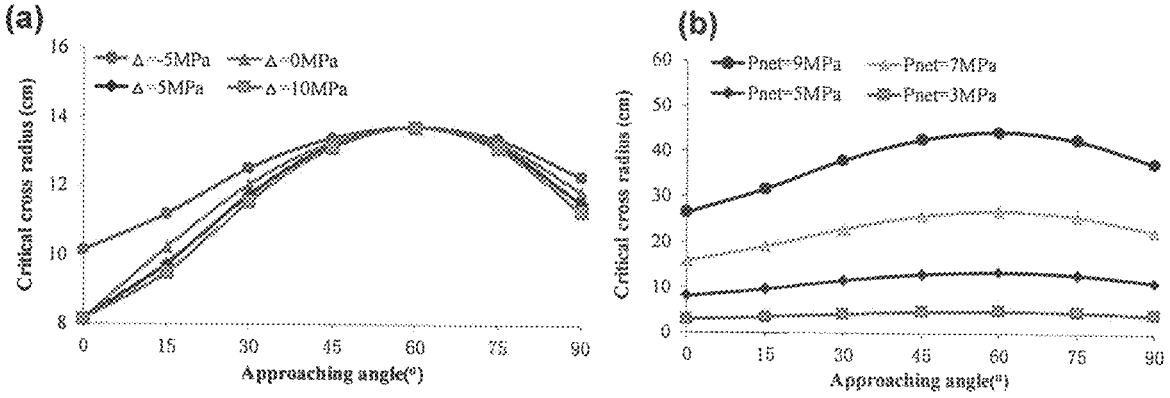
FIG. 13 Crossing critical radius varies with a stress difference and net pressure: (a) Critical radius verses stress difference; (b) Critical radius verses net pressure.

FIG. 12 illustrates that it is possible to create a new fracture across the NF interface when the compressive stress exerted on the HF interface is sufficiently great. FIG. 13 illustrates that the crossing critical radius varies with a stress difference and net pressure. A crossing critical radius in effect means a new fracture reinitiation point forming at the NF at a distance away from the conjunction point. The greater the crossing critical radius, the greater the probability of more complex fracture networks being formed. It is accordingly illustrated that once the HF crosses a pre-existing NF, the critical radius increases as the stress difference decreases (FIG. 13*a*), and increases as the net pressure increases (FIG. 13*b*). The magnitude of the crossing critical radius reaches a maximum when the approaching angle is 60°. Accordingly, applying operational measures to decrease the stress anisotropy and increase the net pressure will increase fracture network complexity.

Figure 14:
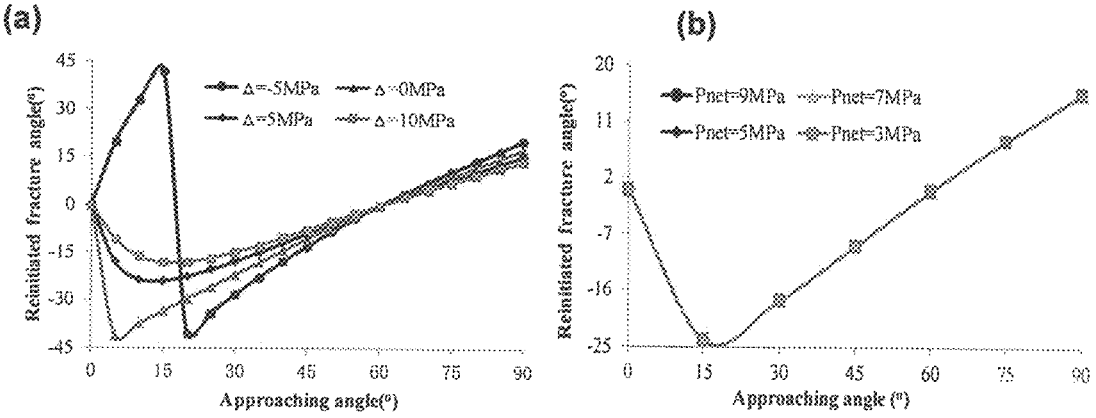
FIG. 14 Reinitiated fracture angle for a stress difference and net pressure: (a) Reinitiated fracture angle verses a stress difference; (b) Reinitiated fracture angle verses net pressure.

Once a HF crosses a NF, as the new HF initiates, the NF will further propagate away from its initiation point, and the reinitiation angle represents the new HF propagation direction with the direction of the maximum horizontal principal stress. The greater the fracture initiation angle, the more complex the fracture network is. Under different approaching angles, the reinitiation fracture angle increases as the stress difference decreases (FIG. 14*a*). When the approaching angle is 60°, regardless of the magnitude of the stress difference, the reinitiation fracture angle equals 0. The reinitiating fracture angle is independent of net pressure (FIG. 14*b*).

Well Completion Pattern Optimization

As indicated above, more complex fracture networks may form during the hydraulic treatment in the presence of NFs. The NFs can alter the way HFs propagate through the formation, causing a complex network of fractures. Operators are accordingly able to utilize the induced stress to reduce the horizontal stress difference and increase net pressure, to promote fracture network complexity. The following operational parameters are accordingly available to achieve this result.

Perforation Parameters

In selecting embodiments, particularly important parameters are perforation length for each cluster and perforation density. For the exemplified LMX shale gas reservoirs, the perforation strategies are as follows:

- Perforation clusters in single stage: A minimum of 2 to 5 perforation clusters are selected for each stage, in an arrangement in which the induced stresses resulting from propped fractures are used to decrease stress isotropy or even promote reversal.
- Length of each perforation cluster: The length of each perforation cluster is selected to be 0.5 m, with a 180° perforation phase angle selected so as to facilitate a single planar fracture initiated from each perforation cluster.
- Perforation density and bullets: The middle perforation cluster initiation pressure must be larger than that of end cluster initiation pressures. In the fracture pressure prediction model (Li, Li et al. 2006), from the field-perforating bullets database the perforation depth is 725 mm and the diameter is 6.87 mm, respectively.

Figure 15:
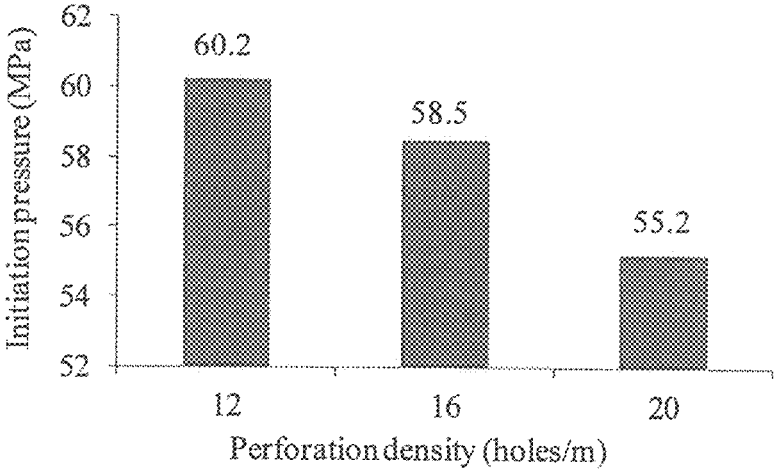
FIG. 15 Initiation pressure versus perforation density.

The predicted initiation pressures are shown in FIG. 15, based on the parameters listed in Table 1. The initiation pressures decrease as the perforation density increases. Given that the initiation pressure is strongly dependent on the perforation density, the perforation density may be used as the operational parameter that is adjusted to control the initiation sequence of different perforation dusters. For the LMX formation, as the perforation density increases from 12 holes/m to 16 holes/m and 20 holes/m, the initiation pressure decreases from 60.2 MPa to 58.5 MPa and 55.2 MPa. In the field Example, the perforation cluster 1 and cluster 3 were arranged with a high perforation density, i.e.: 20 holes/m, while the density for cluster 2 is 12 holes/m.

Fracture Distance

Figure 16:
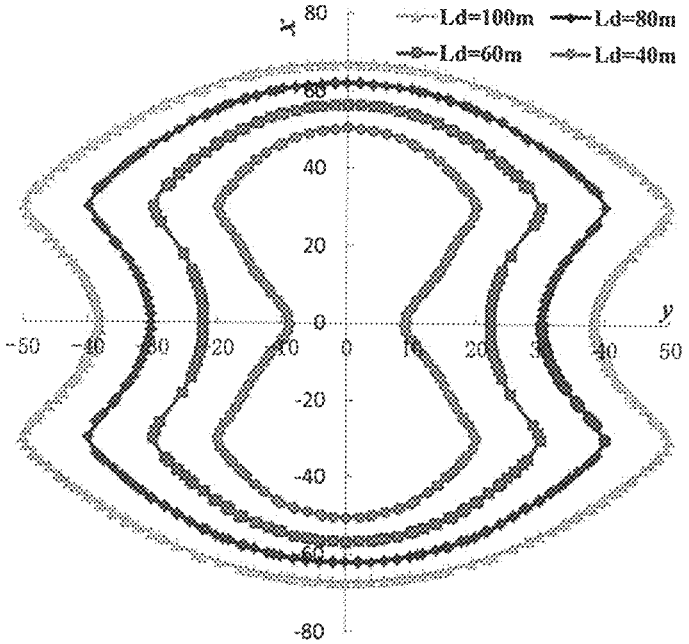
FIG. 16 Comparison of a stress reversal area versus a fracture space of perforation clusters 1 and 3.

Increasing the induced stress difference is an available means for promoting complexity of a fracture network. FIG. 16 shows a comparison of a stress reversal area with altering a fracture distance. The y-axis represents the horizontal wellbore and the x-axis is the fracture extension direction. The different color of each curve represents the boundary of the stress reversal region, while its circle implies a stress fully reversed area. Based on the results of the calculations of FIG. 6, FIG. 9, FIG. 12, FIG. 13(*a*), and FIG. 14(*a*), the larger the stress reversal area, the easier it is to form a complex fracture network. When the distance between perforation clusters 1 and 3 is 40 m, the HF extension direction reversal distance was 50.5 m, while along the horizontal wellbore direction it is 17.86 m. When the distance is 60 m, the corresponding values are 56.53 m and 44.24 m. When the fracture distance is 80 m, the corresponding values are 62.12 m and 60.26 m. Accordingly, in order to create nearby and far-field complex fracture networks, an appropriate perforation cluster distance of perforation clusters 1 and 3 is 60 m to 80 m.

Fracture Length

Figure 17:
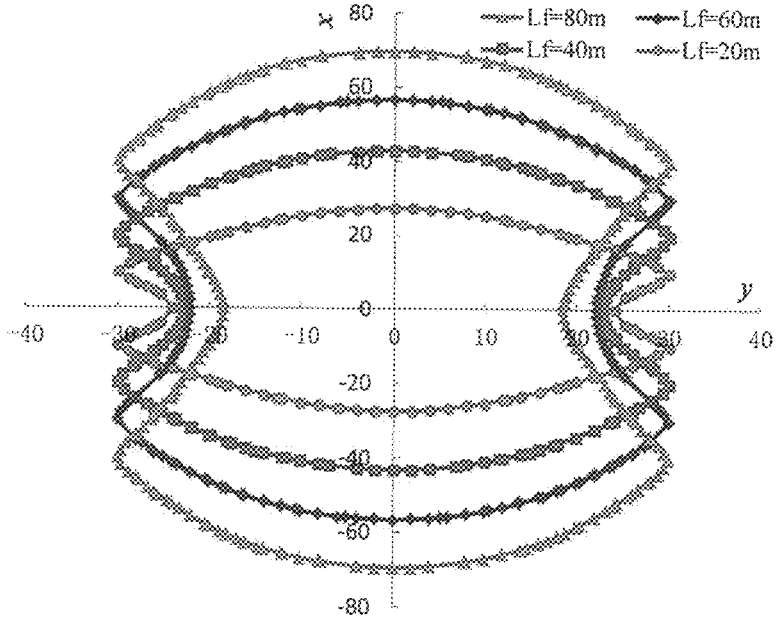
FIG. 17. Comparison of a stress reversal area versus a fracture length.

FIG. 17 illustrates a comparison of stress reversal areas achieved with different fracture lengths in fracture interval 1 and fracture interval 3, in which the distance between fracture interval 1 and fracture interval 3 is 60 m. The y-axis represents the horizontal wellbore and the x-axis is the fracture extension direction. The color of different lines represents the boundary of the stress inversion regions, and inside the lines is the stress inversion area. As illustrated, the induced stress reversal control area increases along the fracture propagation direction, while falling the width, as the length of fractures 1 and 3 increases. Accordingly, in order to increase fracture complexity both adjacent to and distant from the horizontal wellbore area, it is beneficial to limit fracture 1 and fracture 3 extensions to 60 m, and then induce fracturing at perforation cluster 2.

Injection Rate

Figure 18:
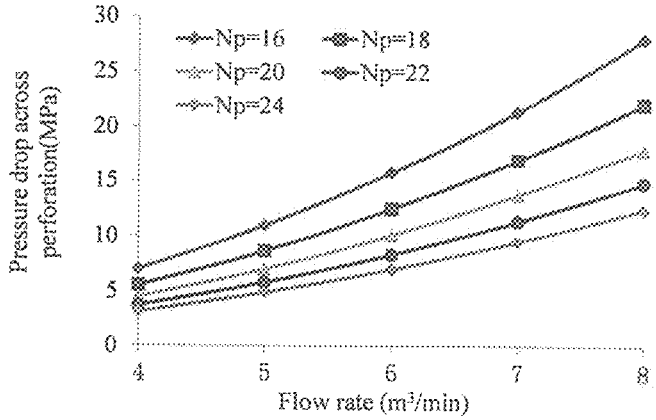
FIG. 18 Friction pressure versus a flow rate.

FIG. 18 illustrates a pressure drop across perforations as it relates to a flow rate with different numbers of perforations (Np). The pressure drop only exists when the flow passes through perforations. FIG. 18 illustrates that the Np and flow rate have profound effects on the pressure drop across perforations. The pressure drop increases as the flow rate increases, while it occurs as Np decreases. During the HF extension stage, it is accordingly possible to control the bottom hole treating pressure by adjusting a flow rate.

Figure 19:
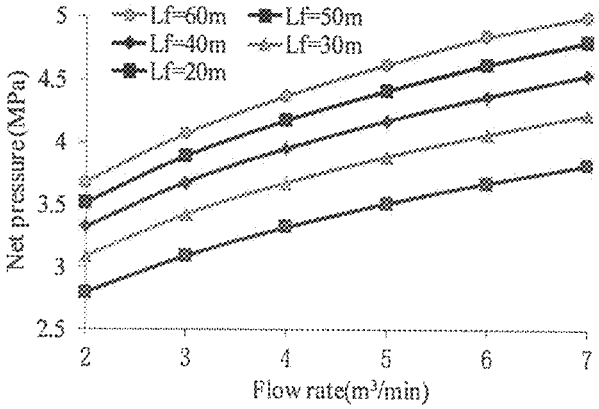
FIG. 19 Net pressure versus a flow rate.

FIG. 19 illustrates the impact of a flow rate on net pressure under different fracture length conditions. The net pressure increases as the flow rate and fracture length increases. Considering the total flow rate to separate equally into fracture 1 and fracture 3, FIG. 19 reflects a calculation of half of the total flow rate. As the fracture network complexity increases with the net pressure increase (FIG. 8, FIG. 11, and FIG. 13 (*b*)), it is important to increase net pressure. For example, when the injection rate is 6 $m^3$/min, the net pressure within the fractures is 4.8 MPa for fracture length 60 m, which is beneficial for the formation of a complex fracture network.

Field Implementation

An exemplary altered alternate fracturing (AAF) horizontal well was drilled with a horizontal length of 1,159 m, which featured both opened and closed NFs. The well was completed with 127 mm casing, perforations and multi-staged hydraulic fracturing. Perforation clusters were evaluated for high effective porosity and permeability distributions so as to facilitate hydraulic fracturing to form complex fracture networks. The horizontal wellbore was separated into 12 stages, with 2-3 perforation clusters in each stage. Perforation cluster spacing varied from 24-30 m, and different perforation parameters were employed for different perforation clusters, in each case so that the outside perforations initiate and extend simultaneously and then the middle perforation cluster initiates. A summary of the relevant parameters is provided in Table 2.

TABLE 2

Construction parameters of well with altered alternate fracturing (AAF)

| Stage | Perforation dusters | Perforated interval (m) | Perforation cluster spacing (m) | Perforations density(holes/m) | Predicting initiation pressure (MPa) | Flow rate ($m^3$/min) | Fluid volume ($m^3$) | Sand volume ($m^3$) |
|---|---|---|---|---|---|---|---|---|
| 1 | 1-1 | 3726-3726.5 | 30 | 16 | 58.5 | 5.6-9.2 | 1130 | 67.1 |
| | 1-2 | 3696-3696.5 | | 16 | 58.5 | | | |
| 2 | 2-1 | 3659-3659.5 | 30 | 20 | 55.2 | 6.1-12 | 1900 | 80.1 |
| | 2-2 | 3629-3629.5 | 30 | 12 | 60.2 | | | |
| | 2-3 | 3599-3599.5 | | 20 | 55.2 | | | |
| 3 | 3-1 | 3574-3574.5 | 30 | 20 | 55.2 | 9.0-12 | 1872 | 56.7 |
| | 3-2 | 3544-3544.5 | 29 | 12 | 60.2 | | | |
| | 3-3 | 3515-3515.5 | | 20 | 55.2 | | | |
| 4 | 4-1 | 3490-3490.5 | 25 | 20 | 55.2 | 12-13.5 | 1785 | 80.1 |
| | 4-2 | 3465-3465.5 | 25 | 12 | 60.2 | | | |
| | 4-3 | 3440-3440.5 | | 20 | 55.2 | | | |
| 5 | 5-1 | 3411-3411.5 | 30 | 20 | 55.2 | 9.5-13 | 1918 | 80.6 |
| | 5-2 | 3381-3381.5 | 29 | 12 | 60.2 | | | |
| | 5-3 | 3352-3352.5 | | 20 | 55.2 | | | |
| 6 | 6-1 | 3330-3330.5 | 25 | 20 | 55.2 | 11-12 | 1862 | 80.1 |
| | 6-2 | 3305-3305.5 | 29 | 12 | 60.2 | | | |
| | 6-3 | 3276-3276.5 | | 20 | 55.2 | | | |
| 7 | 7-1 | 3251-3251.5 | 27 | 20 | 55.2 | 12-13 | 1897 | 82.1 |
| | 7-2 | 3224-3224.5 | 27 | 12 | 60.2 | | | |
| | 7-3 | 3197-3197.5 | | 20 | 55.2 | | | |
| 8 | 8-1 | 3174-3174.5 | 30 | 20 | 55.2 | 10-12 | 1672 | 82.6 |
| | 8-2 | 3144-3144.5 | 29 | 12 | 60.2 | | | |
| | 8-3 | 3115-3115.5 | | 20 | 55.2 | | | |
| 9 | 9-1 | 3090-3090.5 | 24 | 20 | 55.2 | 11-12 | 1759 | 84.4 |
| | 9-2 | 3066-3066.5 | 31 | 12 | 60.2 | | | |
| | 9-3 | 3040-3035.5 | | 20 | 55.2 | | | |
| 10 | 10-1 | 3018-3018.5 | 30 | 20 | 55.2 | 12-14 | 1926 | 86.7 |
| | 10-2 | 2988-2988.5 | 31 | 12 | 60.2 | | | |
| | 10-3 | 2957-2957.5 | | 20 | 55.2 | | | |

TABLE 2-continued

Construction parameters of well with altered alternate fracturing (AAF)

| Stage | Perforation dusters | Perforated interval (m) | Perforation cluster spacing (m) | Perforations density(holes/m) | Predicting initiation pressure (MPa) | Flow rate ($m^3$/min) | Fluid volume ($m^3$) | Sand volume ($m^3$) |
|---|---|---|---|---|---|---|---|---|
| 11 | 11-1 | 2939-2939.5 | 30 | 20 | 55.2 | 12-14 | 1792 | 82.1 |
| | 11-2 | 2909-2909.5 | 26 | 12 | 60.2 | | | |
| | 11-3 | 2883-2883.5 | | 20 | 55.2 | | | |
| 12 | 12-1 | 2857-2861.5 | 30 | 20 | 55.2 | 12-14 | 1819 | 82.6 |
| | 12-2 | 2831-2831.5 | 30 | 12 | 60.2 | | | |
| | 12-3 | 2805-2801.5 | | 20 | 55.2 | | | |

Fracturing operations took place from the horizontal wellbore toe towards the heel. Bridge plugs were used to separate different fracturing stages, with unified drainage when complete. A total of 945.2 $m^3$ of 40-70 mesh ceramic was injected, and the sand carrying fluid was slick water in a volume of 21332 $m^3$, flow rates varied from 5.6-14 $m^3$/min, and the wellhead pressure varied between 64-78 MPa.

Figure 20:
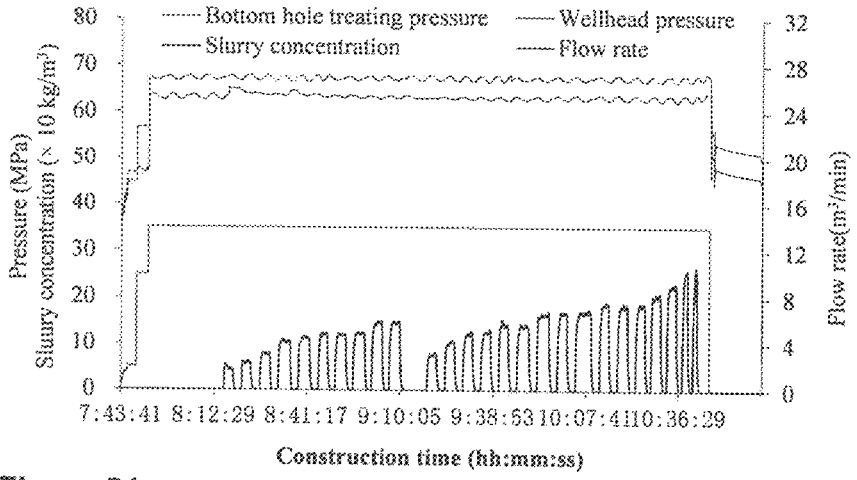
FIG. 20 The fifth stage fracturing construction curve.

FIG. 20 is the construction curve of the fifth fracturing stage. This stage was completed with three perforation clusters at a distance of 29 m and 30 m, respectively. The perforation cluster parameters were as follows: the length of each perforation cluster is 0.5 m, the perforation density for cluster 1 and cluster 3 is 20 holes/m, while 12 holes/m for perforation cluster 2. Based on FIG. 15, the predicting initiation pressures for cluster 1 and cluster 3 are 55.2 MPa, while it is 60.2 MPa for cluster 2. In FIG. 20, the black line represents a flow rate, the blue line is wellhead pressure, while the red line represents the bottom hole treating pressure. During the construction process, the well bottom treating pressure was calculated using equations (28)-(31) to match the treatments (FIG. 20). The construction can be separated into three stages: First, as the injection rate increases from 0 to 2.0 $m^3$/min and to 10.0 $m^3$/min, the well bottom treating pressure increases from 0 MPa to 44.9 MPa and to 56.7 MPa, which induces clusters 1 and 3 to initiate while cluster 2 remains closed (Eq. (32)). The injection rate was kept constant at 10.0 $m^3$/min for an injection time 140 seconds (Eq. (30)) to facilitate a fracture 1 and fracture 3 extension length of approximately 60 m. Second, increasing the injection rate from 10 $m^3$/min to 14 $m^3$/min, the pressure drop across perforations is 13.7 MPa (FIG. 18), and the net pressure is 5 MPa, according to eq. (28), the well bottom hole treating pressure reached 45+13.7+5=63.7 MPa, which facilitates the extension of fracture 1 and fracture 3, and opening of perforation cluster 2 (Eq. (35)). Hence fractures 1, 2 and 3 extend simultaneously. As indicated by FIG. 20, the well bottom hole treating pressure fluctuated between 66.0 MPa and 67.8 MPa, which is another indicator of multiple NFs interacting with HFs.

Figure 21:
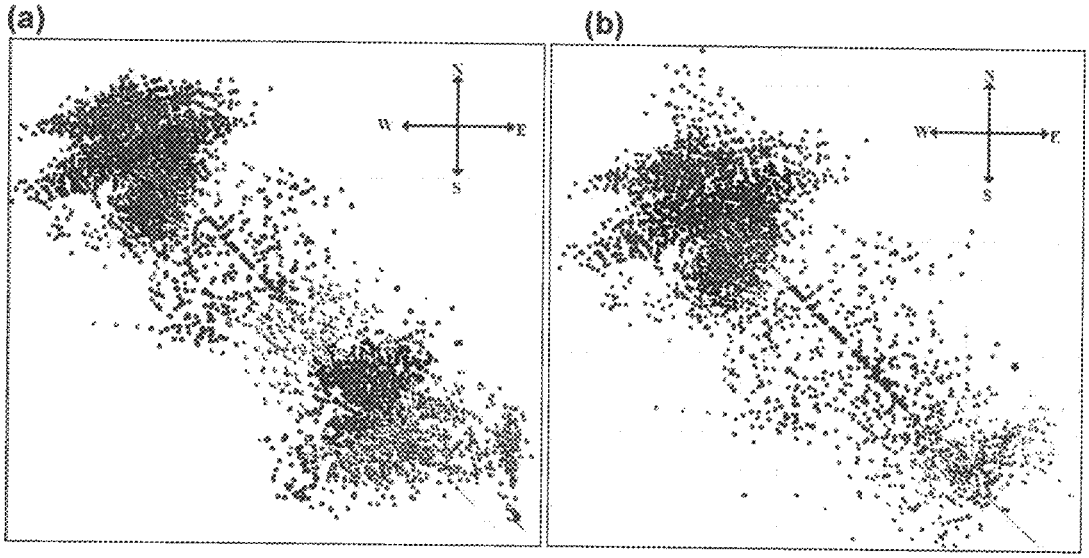
FIG. 21 Micro seismic events of altered alternate fracturing and conventional fracturing: (a) Altered alternate fracturing; (b) Conventional fracturing.

Microseismic data may be used to monitor the HF energy placement and propagation, through the detection of microseisms created by the fracturing of the reservoir. Visualization of the character of microseisms illustrates the event patterns and the fracture geometry, showing interactions with NFs and providing an estimate of the stimulated reservoir volume (Xie, Yang et al. 2015, Norbeck and Horne 2016). FIG. 21 represents the microseismic events of the exemplified embodiment (FIG. 21(*a*)) compared to conventional fracturing (FIG. 21(*b*)) for two adjacent wells, each having undergone 12 stimulation stages. In the two adjacent wells, both trending N50° E, their fracture half-length is 180-220 m and fracture width growth is 30-50 m. It is apparent from the data that the exemplified embodiment induces more microseismic events than conventional fracturing, which illustrates that the exemplified embodiment promotes more complexity fracture networks.

Figure 22:
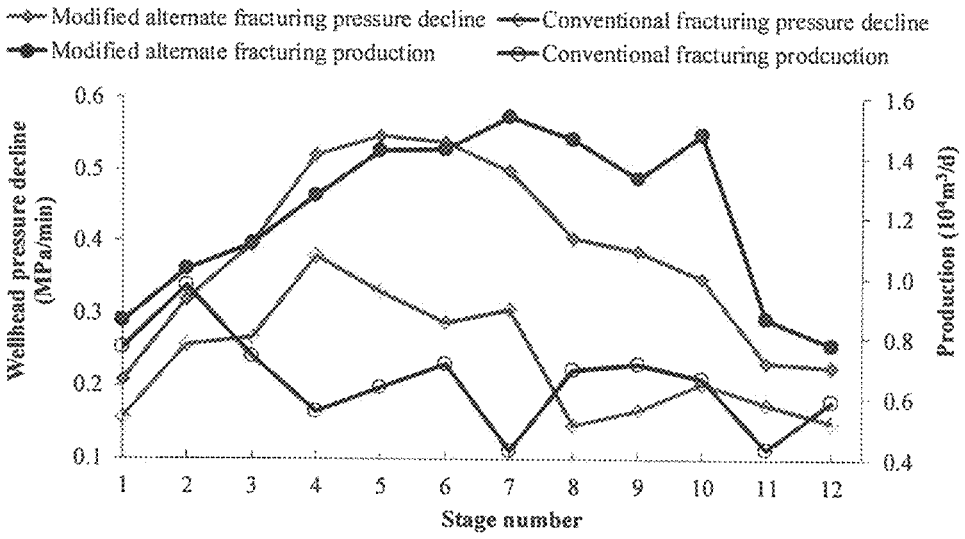
FIG. 22 Comparison pressure decline and production of different fracturing patterns for each stage FIG. 23 Comparison wellhead pressure and daily production of different fracturing patterns.

FIG. 22 illustrates that the wellhead pressure of the exemplified embodiment declined faster than that of conventional fracturing. The well head pressure drop rate post fracturing is a comprehensive reflection of the complexity of stimulated fractures. The faster pressure drop is indicative of a more complex fracture network, formed as a result of high fluid loss in fracturing. The exemplified embodiment creates a much more complex fracture network by placing the third HF in low stress anisotropy regions (FIG. 21), which can also be reflected by stage-by-stage production tests. Spinner data was collected a month after hydraulic stimulation of each well. The production profiles for each well are shown in FIG. 22 (Stage 1 referring to the toe of the wellbore). From the production profile it is clear that stage 4 to stage 10 contribute the majority of the total flow and stages 1, 11 and 12 contribute the least of the total flow. The production profile for the conventional well shows a much more uniform and lower flow contribution from each stage. Stage 7 only contributes $0.42\times10^4$ $m^3$/d of the flow and was anomalously low.

Figure 23:
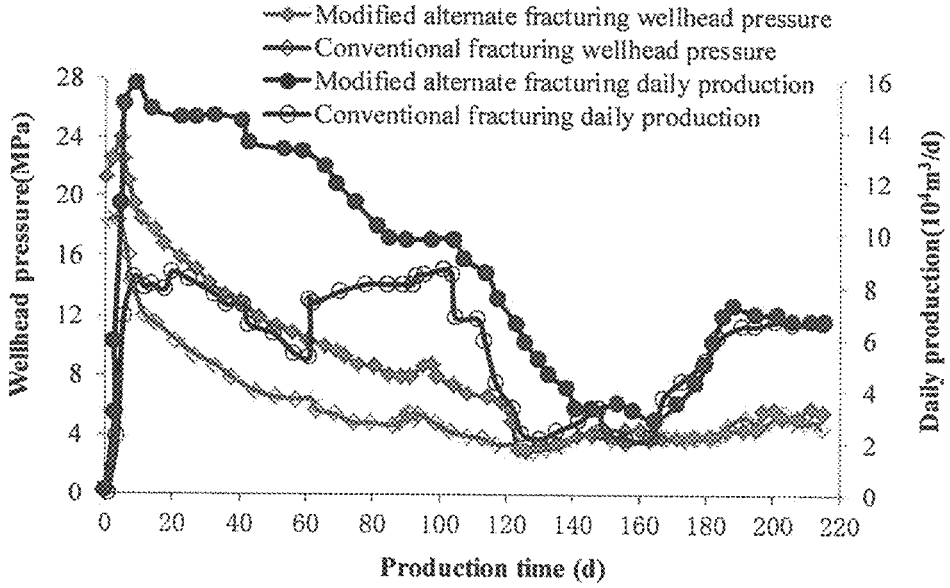

FIG. 23 is a comparison of wellhead pressure and daily production for different fracturing patterns 7 months post hydraulic fracturing. The results show that the exemplified altered alternate fracturing pattern not only exhibits a much higher initial daily production, and earlier production peak, compared to that of conventional fracturing, but also exhibits a reduced well-head pressure drop. This reflects the larger stimulated volume of the exemplified embodiment, which provides more seepage channels into the reservoir. In contrast, conventional fracturing is prone to form planar fractures connecting the horizontal wellbore and the formation, which only extracts gas from a limited drainage region, which results in a sharp decline of wellhead pressure and daily production post stimulation.

This Example illustrates that the presently disclosed methods result in more efficient fracture stimulation, leading to higher well productivity and a slower wellhead pressure decline. In the exemplified approach, the interaction of NFs and HFs is considered in a manner that enhances the complexity of hydraulic fracture networks. Aspects of this approach involve decreasing stress anisotropy by stress interference from induced hydraulic fractures and increasing net pressure, which in combination create a high conductive area between formation and wellbore. A combination of perforation density optimization and real-time adjustment of injection rates is used to ensure the fracture initiation order and extension sequence to aid the formation of complex fracture networks.

REFERENCES

Akulich, A. and A. Zvyagin (2008). "Interaction between hydraulic and natural fractures." Fluid dynamics 43(3): 428-435.

Anderson, G. D. (1981). "Effects of friction on hydraulic fracture growth near unbonded interfaces in rocks." Society of Petroleum Engineers Journal 21(01): 21-29.

Barton, C. A., M. D. Zoback and D. Moos (1995). "Fluid flow along potentially active faults in crystalline rock." Geology 23(8): 683-686.

Chen, Z., X. Liao, X. Zhao, X. Dou and L. Zhu (2015). "Performance of horizontal wells with fracture networks in shale gas formation." Journal of Petroleum Science and Engineering 133: 646-664.

Cheng, Y. (2012). "Mechanical interaction of multiple fractures-exploring impacts of the selection of the spacing/number of perforation clusters on horizontal shale-gas wells." SPE Journal 17(04): 992-991,001.

Cho, Y., E. Ozkan and O. G. Apaydin (2013). "Pressure-dependent natural-fracture permeability in shale and its effect on shale-gas well production." SPE Reservoir Evaluation & Engineering 16(02): 216-228.

Chuprakov, D., O. Melchaeva and R. Prioul (2014). "Injection-sensitive mechanics of hydraulic fracture interaction with discontinuities." Rock Mechanics and Rock Engineering 47(5): 1625-1640.

Cipolla, C. L. (2009). "Modeling production and evaluating fracture performance in unconventional gas reservoirs." Journal of Petroleum Technology 61(09): 84-90.

Clarkson, C. R. (2013). "Production data analysis of unconventional gas wells: Review of theory and best practices." International Journal of Coal Geology 109: 101-146.

Dahi-Taleghani, A. and J. E. Olson (2011). "Numerical modeling of multistranded-hydraulic-fracture propagation: Accounting for the interaction between induced and natural fractures." SPE journal 16(03): 575-581.

Daneshy, A. A. (1974). Hydraulic fracture propagation in the presence of planes of weakness. SPE European Spring Meeting, Society of Petroleum Engineers.

De Barros, L., G. Daniel, Y. Guglielmi, D. Rivet, H. Caron, X. Payre, G. Bergery, P. Henry, R. Castilla and P. Dick (2016). "Fault structure, stress, or pressure control of the seismicity in shale? Insights from a controlled experiment of fluid-induced fault reactivation." Journal of Geophysical Research: Solid Earth 121(6): 4506-4522.

East, L., M. Y. Soliman and J. R. Augustine (2011). "Methods for enhancing far-field complexity in fracturing operations." SPE Production & Operations 26(03): 291-303.

Economides, M. J. and K. G. Nolte (2000). Reservoir stimulation, Wiley New York.

Genshen-Li, Li-Liu and Zhongwei-Huang (2006). "Study of effect of hydraulic perforation on formation fracturing pressure." Journal of China University of Petroleum 30(5): 42-45.

Gale, J. F., R. M. Reed and J. Holder (2007). "Natural fractures in the Barett Shale and their importance for hydraulic fracture treatments." AAPG bulletin 91(4): 603-622.

Gu, H., X. Weng, J. B. Lund, M. G. Mack, U. Ganguly and R. Suarez-Rivera (2012). "Hydraulic fracture crossing natural fracture at nonorthogonal angles: a criterion and its validation." SPE Production & Operations 27(01): 20-26.

Guo, T., S. Zhang, Z. Qu, T. Zhou, Y. Xiao and J. Gao (2014). "Experimental study of hydraulic fracturing for shale by stimulated reservoir volume." Fuel 128: 373-380.

Holditch, S. A. (2006). "Tight gas sands." Journal of Petroleum Technology 58(06): 86-93.

Huang, J., Z. Caineng, L. Jianzhong, D. Dazhong, W. Sheiiao, W. Shiqian and K. CHENG (2012). "Shale gas generation and potential of the Lower Cambrian Qiongzhusi Formation in the Southern Sichuan Basin, China." Petroleum Exploration and Development 39(1): 75-81.

Jaeger, J. C., N. G. Cook and R. Zimmerman (2009). Fundamentals of rock mechanics, John Wiley & Sons.

Ketter, A. A., J. L. Daniels, J. R. Heinze and G. Waters (2008). "A field study in optimizing completion strategies for fracture initiation in Barnett Shale horizontal wells." SPE Production & Operations 23(03): 373-378.

Khristianovic, S. and Y. Zheltov (1955). Formation of vertical fractures by means of highly viscous fluids. Proc. 4th world petroleum congress, Rome.

Kresse, O., X. Weng, H. Gu and R. Wu (2013). "Numerical modeling of hydraulic fractures interaction in complex naturally fractured formations." Rock mechanics and rock engineering 46(3): 555-568.

Kundu, T. (2008). Fundamentals of fracture mechanics, CRC press.

Lam, K. and M. Cleary (1984). "Slippage and re-initiation of (hydraulic) fractures at frictional interfaces." International Journal for Numerical and Analytical Methods in Geomechanics 8(6): 589-604.

Laubach, S. E. (2003). "Practical approaches to identifying sealed and open fractures." AAPG bulletin 87(4): 561-579.

Leung, C. T. and R. W. Zimmerman (2012). "Estimating the hydraulic conductivity of two-dimensional fracture networks using network geometric properties." Transport in porous media 93(3): 777-797.

Liu, C., H. Liu, Y. Zhang, D. Deng and H. Wu (2015). "Optimal spacing of staged fracturing in horizontal shale-gas well." Journal of Petroleum Science and Engineering 132: 86-93.

Manchanda, R. and M. M. Sharma (2014). "Impact of Completion Design on Fracture Complexity in Horizontal Shale Wells." SPE Drilling & Completion 29(01): 78-87.

Mayerhofer, M. J., E. Lolon, N. R. Warpinski, C. L. Cipolla, D. W. Walser and C. M. Rightmire (2010). "What is stimulated reservoir volume?" SPE Production & Operations 25(01): 89-98.

Norbeck, J. H. and R. N. Horne (2016). "Physical mechanisms related to microseismic-depletion-delineation field tests with application to reservoir surveillance." SPE Journal.

Roussel, N. P. and M. M. Sharma (2011). "Optimizing fracture spacing and sequencing in horizontal-well fracturing." SPE Production & Operations 26(02): 173-184.

Shakib, J. T. (2013). "RETRACTED: Numerical modeling of hydraulic fracture propagation: Accounting for the effect of stresses on the interaction between hydraulic and parallel natural fractures." Egyptian Journal of Petroleum 22(4): 557-563.

Sneddon, I. and H. Elliot (1946). "The opening of a Griffith crack under internal pressure." Quart. Appl. Math 4(3): 262-267.

Wang, X., C. Liu, H. Wang, H. Liu and H. Wu (2016). "Comparison of consecutive and alternate hydraulic fracturing in horizontal wells using XFEM-based cohesive zone method." Journal of Petroleum Science and Engineering 143: 14-25.

Warpinski, N. and L. Teufel (1987). "Influence of geologic discontinuities on hydraulic fracture propagation (includes associated papers 17011 and 17074)." Journal of Petroleum Technology 39(02): 209-220.

Weng, X., O. Kresse, C.-E. Cohen, R. Wu and H. Gu (2011). "Modeling of hydraulic-fracture-network propagation in a naturally fractured formation." SPE Production & Operations 26(04): 368-380.

Westergaard, H. (1997). "Bearing pressures and cracks." SPIE MILESTONE SERIES MS 137: 18-22.

Wu, K. and J. E. Olson (2015). "Simultaneous multifracture treatments: fully coupled fluid flow and fracture mechanics for horizontal wells." SPE journal 20(02): 337-346.

Xie, J., C. Yang, N. Gupta, M. J. King and A. Datta-Gupta (2015). "Integration of shale-gas-production data and microseismic for fracture and reservoir properties with the fast marching method." SPE Journal 20(02): 347-359.

Xing, L., Y. Xi, Z. Jiehui and S. Honglin (2011). "Reservoir forming conditions and favorable exploration zones of shale gas in the Weixin Sag, Dianqianbei Depression." Petroleum Exploration and Development 38(6): 693-699.

Yew, C. H. and X. Weng (2014). Mechanics of hydraulic fracturing, Gulf Professional Publishing.

Yushi, Z., Z. Shicheng, Z. Tong, Z. Xiang and G. Tiankui (2016). "Experimental investigation into hydraulic fracture network propagation in gas shales using CT scanning technology." Rock Mechanics and Rock Engineering 49(1): 33-45.

Zeng, F. and J. Guo (2016). "Optimized Design and Use of Induced Complex Fractures in Horizontal Wellbores of Tight Gas Reservoirs." Rock Mechanics and Rock Engineering 49(4): 1411-1423.

Zhang, J., A. Kamenov, A. D. Hill and D. Zhu (2014). "Laboratory Measurement of Hydraulic-Fracture Conductivities in the Barnett Shale." SPE Production & Operations 29(03): 216-227.

Zhou, J., M. Chen, Y. Jin and G.-q. Zhang (2008). "Analysis of fracture propagation behavior and fracture geometry using a tri-axial fracturing system in naturally fractured reservoirs." International Journal of Rock Mechanics and Mining Sciences 45(7): 1143-1152.

CONCLUSION

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

The invention claimed is:

1. A method of inducing a complex fracture network within a zone of a shale hydrocarbon reservoir, wherein the zone comprises a wellbore servicing a plurality of spaced apart fracturing intervals, wherein the reservoir rock has a permeability of from 10-100 nD, the method comprising:

introducing in a fracturing stage contemporaneous fractures into a first fracturing interval and a third fracturing interval, and subsequently introducing during the fracturing stage a fracture into a second fracturing interval, wherein the second fracturing interval is between the first fracturing interval and the third fracturing interval;

wherein fracturing at the first, second and third fracturing intervals is initiated and extended by injection of a fracturing fluid into the intervals through the respective first, second and third perforation clusters in fluid communication through the wellbore and spaced apart along a wellbore casing;

controlling a fracture initiation stage and a hydraulic fracture propagation stage for each of the first, second and third perforation clusters by adjusting an injection rate of the fracturing fluid so as to modulate wellbore bottom pressure;

wherein during the fracture initiation stage:

$$p_b \leq p_{fr},$$

where $p_b$ is the bottom hole treating pressure, and $p_{fr}$ is the perforation cluster initiation pressure; and wherein during the hydraulic fracture propagation stage $p_b$ is adjusted so as to cross, open and shear natural fractures, with:

$$p_b = \sigma_h + \rho_{net} + p_{fef}$$

$$p_{net} = 2.52\left[\frac{E^3 \mu_f q L_f}{(1-\nu^2)^3 H_f^4}\right]^{1/4}$$

$$L_f = 0.395\left[\frac{Eq^3}{2(1-\nu^2)\mu_f H_{HF}^4}\right]^{1/5} t^{4/5}$$

$$p_{fef} = \frac{22.45 q^2 \rho}{N_p^2 d^4 C_d^2}$$

where $\sigma_h$ is the horizontal minimum principal stress, MPa; $p_{net}$ is the HF net pressure, MPa; $p_{fef}$ is a pressure drop across perforations, MPa; E is Young's modulus of reservoir rock, MPa; $\mu_r$ is the injection fluid viscosity, mPa·s; q is the injection rate, $m^3$/min; $L_f$ is the fracture half-length, m; ν is the rock Poison's ratio, dimensionless; $\mu_f$ is the injection fluid viscosity, mPa·s; $H_{HF}$ is the hydraulic fracture height, m; t is the injection time, s; ρ is the fracturing fluid density, $10^{-3}$ kg/$m^3$; Np is the perforation number; d is the perforation diameter, $10^{-2}$ m; $C_d$ is a flow rate coefficient, dimensionless;

wherein, for fracture initiation at perforation clusters 1 and 3, the bottom hole treating pressure is controlled by modulating the injection rate of the fracturing fluid so that:

$$p_{fr2} > p_b > p_{fr1} = p_{fr3}$$

$$p_b = p_{b1} = p_{b2} = p_{b3}$$

wherein subscript 1, 2, 3 represent parameters respectively for perforation clusters 1, 2 and 3;

wherein following the hydraulic fracture propagation stage at perforation clusters 1 and 3, the bottom hole treating pressure is increased to initiate the fracture initiation stage at perforation cluster 2, with the fracture initiation pressure for perforation cluster 2, $P_{fr2}$, being adjusted to account for the induced stress from hydraulic fracture propagation in the first and third fracturing intervals, so that:

$$p_{fr2} \leq p_b$$

$$p_b = p_{b1} = p_{b2} = p_{b3}$$

and wherein perforations in the perforation clusters are arranged and configured so that:

$$p_{fr2} > p_{fr1} = p_{fr3}.$$

2. The method of claim 1, wherein the wellbore is a horizontal wellbore.

3. The method of claim 2, wherein the fracture interval spacing and extension length are selected so as to decrease principal stress anisotropy and thereby promote fracture network complexity through HF and NF interaction, wherein:

$$\Delta\sigma_x = K\cos\frac{\theta}{2}\left(1 - \sin\frac{\theta}{2}\sin\frac{3\theta}{2}\right)$$

$$\Delta\sigma_y = K\left(1 + \sin\frac{\theta}{2}\sin\frac{3\theta}{2}\right)$$

where $\Delta\sigma_x$, $\Delta\sigma_y$ are induced from a HF tip in the x, y direction, MPa.; $K = K_I/\sqrt{2\pi r}\cos(\theta/2)$, $K_I$ is the intensity factor of stress, $MPa \cdot m^{1/2}$; $K_I = p_{net}\sqrt{\pi L_f}$, $p_{net}$ is the HF net pressure, MPa; $L_f$ is the HF half-length, m; r is the distance of an arbitrary point on a NF to the HF tip, m; θ is the angle of a certain point on the NF line to the HF tip with the maximum principal stress direction, °, and at the conjunction point, θ=β.

4. The method of claim 3, wherein the length of each perforation in a perforation cluster is adjusted so that it is at least about four times smaller than the wellbore diameter, thereby facilitating only one primary hydraulic fracture initiated from each perforation cluster.

5. The method of claim 4, wherein there are more than 3 perforation clusters in one fracturing stage.

6. The method of claim 2, wherein the length of each perforation in a perforation cluster is adjusted so that it is at least about four times smaller than the wellbore diameter, thereby facilitating only one primary hydraulic fracture initiated from each perforation cluster.

7. The method of claim 6, wherein there are more than 3 perforation clusters in one fracturing stage.

8. The method of claim 2, wherein there are more than 3 perforation clusters in one fracturing stage.

9. The method of claim 3, wherein there are more than 3 perforation clusters in one fracturing stage.

10. The method of claim 1, wherein the fracture interval spacing and extension length are selected so as to decrease principal stress anisotropy and thereby promote fracture network complexity through HF and NF interaction, wherein:

$$\Delta\sigma_x = K\cos\frac{\theta}{2}\left(1 - \sin\frac{\theta}{2}\sin\frac{3\theta}{2}\right)$$

$$\Delta\sigma_y = K\left(1 + \sin\frac{\theta}{2}\sin\frac{3\theta}{2}\right)$$

where $\Delta\sigma_x$, $\Delta\sigma_y$ are induced from a HF tip in the x, y direction, MPa.; $K = K_I/\sqrt{2\pi r}\cos(\theta/2)$, $K_I$ is the intensity factor of stress, $MPa \cdot m^{1/2}$; $K_I = p_{net}\sqrt{\pi L_f}$, $p_{net}$ is the HF net pressure, MPa; $L_f$ is the HF half-length, m; r is the distance of an arbitrary point on a NF to the HF tip, m; θ is the angle of a certain point on the NF line to the HF tip with the maximum principal stress direction, °, and at the conjunction point, θ=β.

11. The method of claim 10, wherein the length of each perforation in a perforation cluster is adjusted so that it is at least about four times smaller than the wellbore diameter, thereby facilitating only one primary hydraulic fracture initiated from each perforation cluster.

12. The method of claim 11, wherein there are more than 3 perforation clusters in one fracturing stage.

13. The method of claim 10, wherein there are more than 3 perforation clusters in one fracturing stage.

14. The method of claim 1, wherein the length of each perforation in a perforation cluster is adjusted so that it is at least about four times smaller than the wellbore diameter, thereby facilitating only one primary hydraulic fracture initiated from each perforation cluster.

15. The method of claim 14, wherein there are more than 3 perforation clusters in one fracturing stage.

16. The method of claim 1, wherein there are more than 3 perforation clusters in one fracturing stage.

* * * * *